US008291676B2

(12) United States Patent
Hong et al.

(10) Patent No.: US 8,291,676 B2
(45) Date of Patent: Oct. 23, 2012

(54) MOLD-CONCRETE COMPOSITE CROSSBEAM AND CONSTRUCTION METHOD USING THE SAME

(75) Inventors: Won-Kee Hong, Yongin-si (KR); Ki-Soo Hwang, Seoul (KR)

(73) Assignee: KH Housing Solutions Co., Ltd., Yongin-si (KR)

( * ) Notice: Subject to any disclaimer, the term of this patent is extended or adjusted under 35 U.S.C. 154(b) by 1034 days.

(21) Appl. No.: 12/096,395

(22) PCT Filed: Dec. 6, 2006

(86) PCT No.: PCT/KR2006/005231

§ 371 (c)(1),
(2), (4) Date: Jun. 6, 2008

(87) PCT Pub. No.: WO2007/066971

PCT Pub. Date: Jun. 14, 2007

(65) Prior Publication Data

US 2008/0282644 A1 Nov. 20, 2008

(30) Foreign Application Priority Data

Dec. 7, 2005 (KR) ..... 10-2005-0118845

(51) Int. Cl.
*E04G 21/02* (2006.01)
*E04B 1/20* (2006.01)
*E04B 5/18* (2006.01)

(52) U.S. Cl. ..... 52/745.13; 52/252; 52/340; 52/414

(58) Field of Classification Search ..... 52/251, 52/252, 340, 414, 745.05, 745.13
See application file for complete search history.

(56) References Cited

U.S. PATENT DOCUMENTS 6,219,989 B1 4/2001 Tumura

FOREIGN PATENT DOCUMENTS

| | | |
|---|---|---|
| JP | 60-23537 | 2/1985 |
| JP | 4-254646 | 9/1992 |
| JP | 10-152887 | 6/1998 |
| JP | 11-100897 | 4/1999 |
| KR | 10-0227463 | 8/1999 |

OTHER PUBLICATIONS

Search Report issued in International Patent Application No. PCT/KR2006/005231 on Mar. 12, 2007.

*Primary Examiner* — Michael Safavi
(74) *Attorney, Agent, or Firm* — Stein McEwen, LLP

(57) ABSTRACT

A mold-concrete composite crossbeam includes a H-steel composed of upper and lower flanges and a web connecting them; a concrete member formed in a length direction of the H-steel to expose the upper flange out but bury the lower flange and the web partially; deck plate supports installed to both upper side edges of the concrete member to support a deck plate placed thereon; a reinforcing steel bar installed around the H-steel; a mold including a bottom detachably coupled to a lower end surface of the concrete member, and sidewalls formed in parallel to both sides of the bottom and detachably coupled to both end sides of the concrete member; a lateral reinforcing member coupled across both sidewalls; a side reinforcing member installed to an outer side of the sidewalls in a length direction; and bottom reinforcing members installed across a lower surface of the bottom.

16 Claims, 28 Drawing Sheets

[Fig. 1]
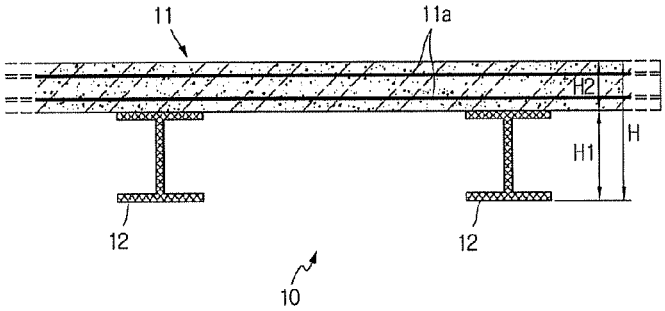
[Fig. 2]
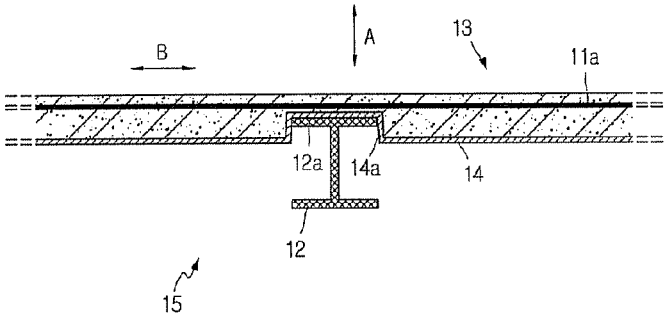
[Fig. 3]
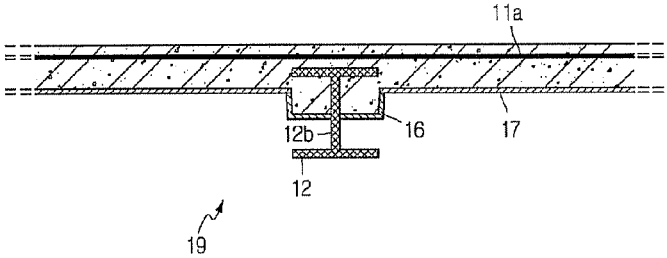
[Fig. 4]
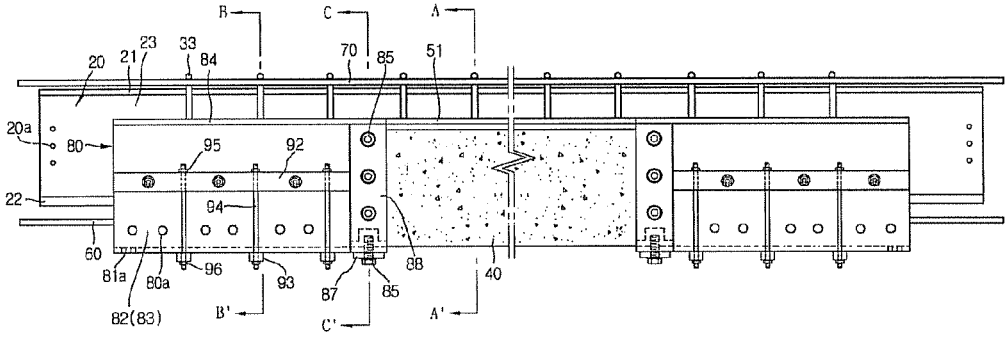

[Fig. 5]
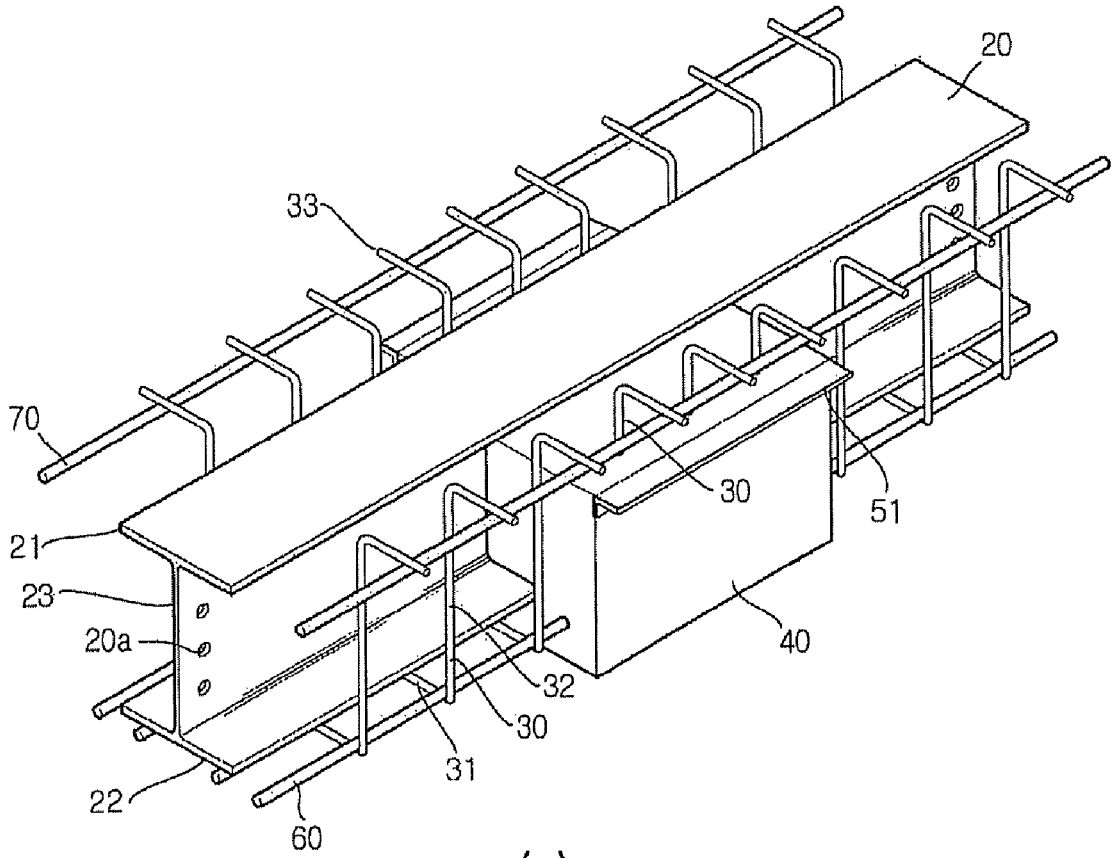
(a)
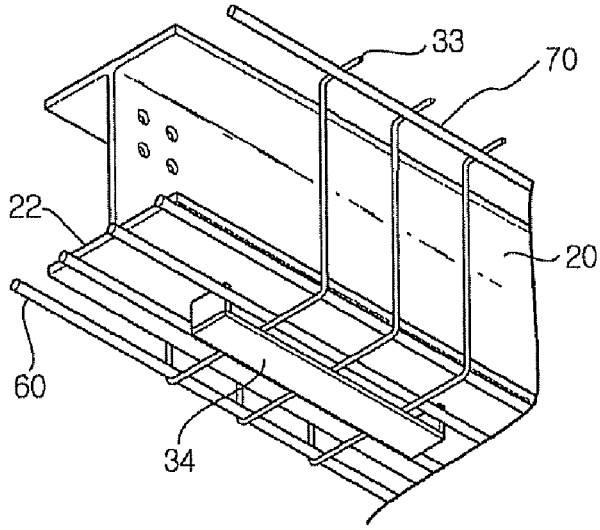
(b)

[Fig. 6]
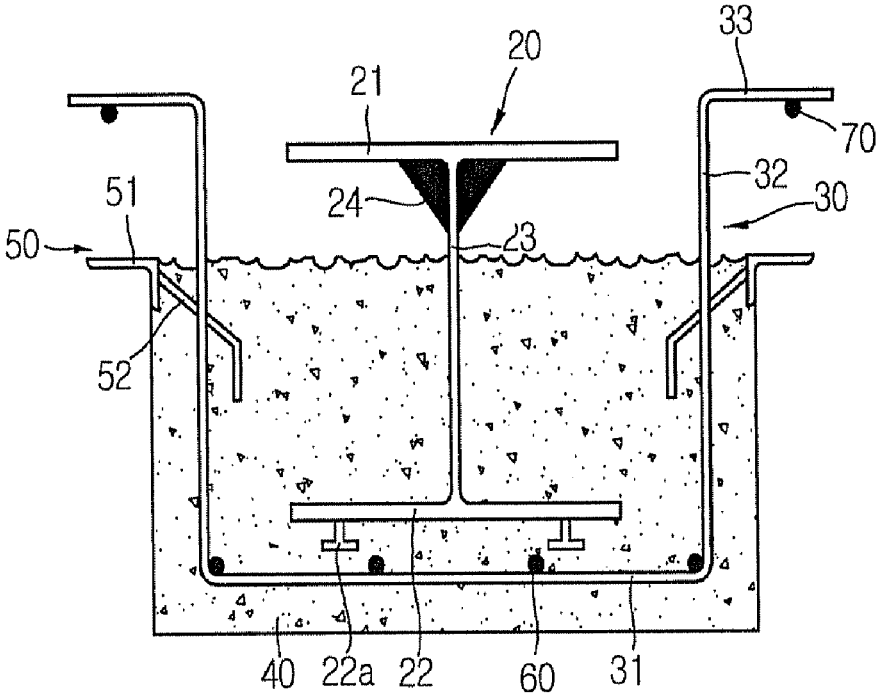
[Fig. 7]
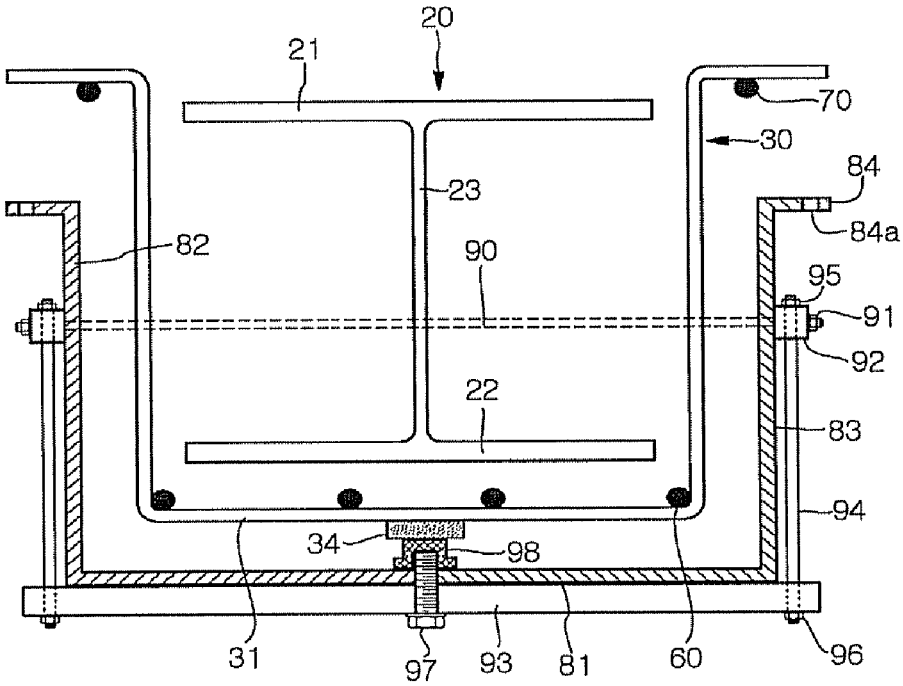

[Fig. 8]
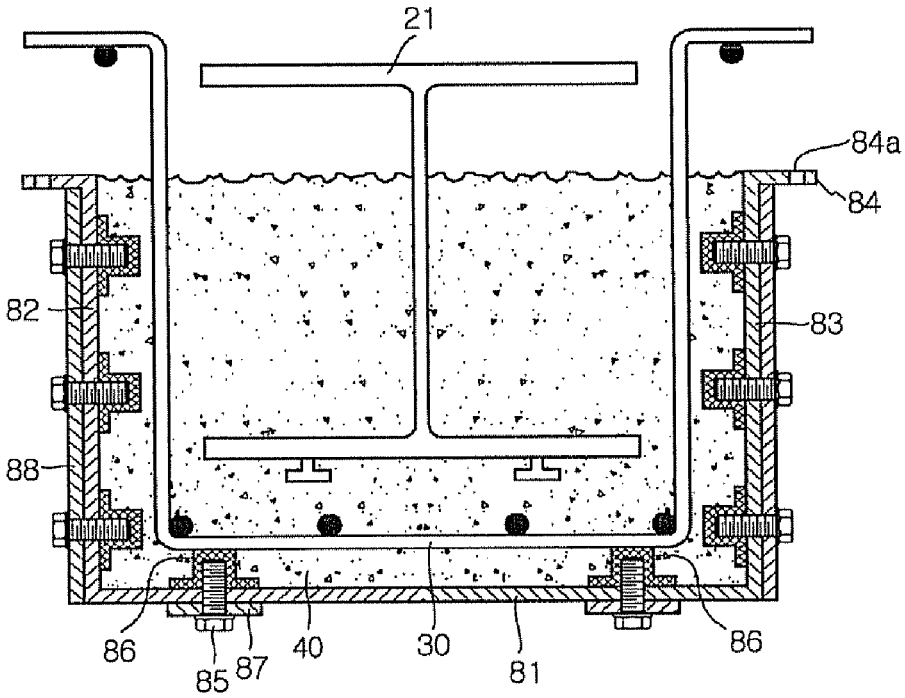
[Fig. 9]
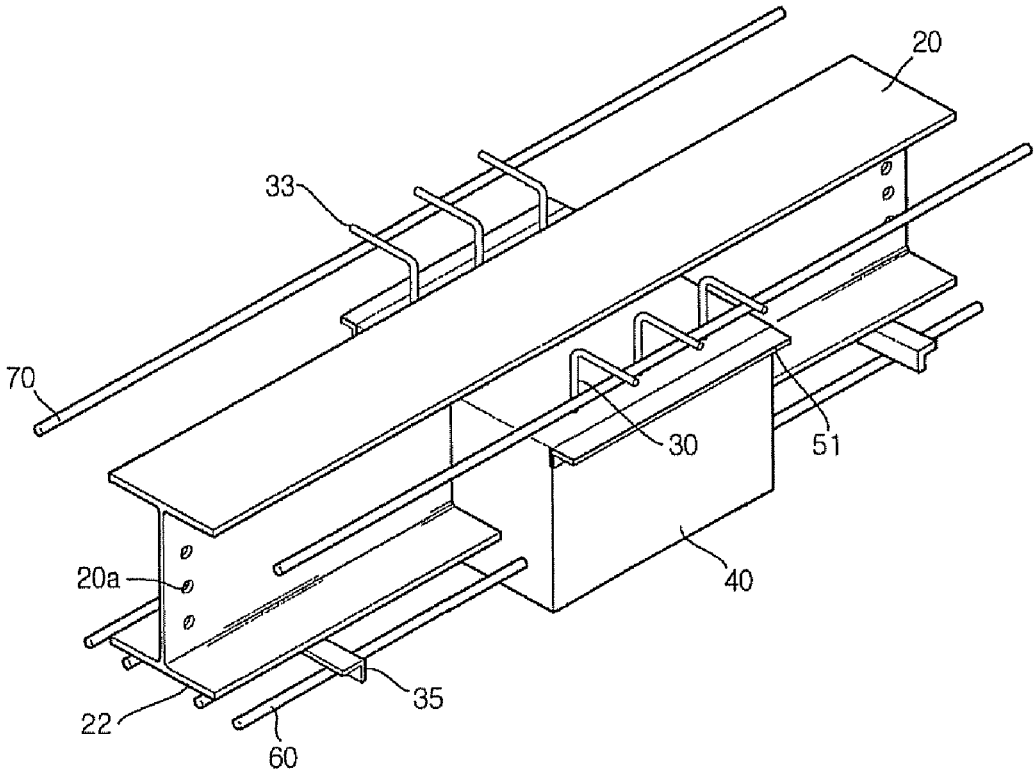

[Fig. 10]
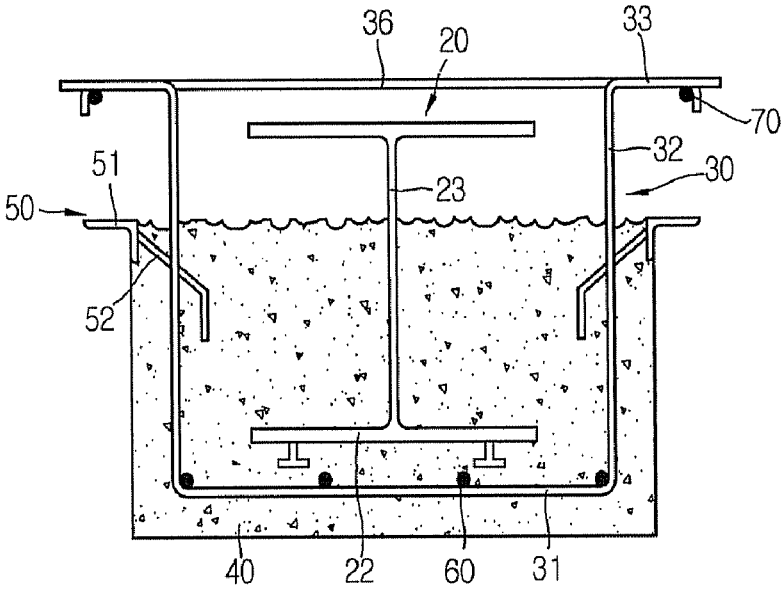
[Fig. 11]
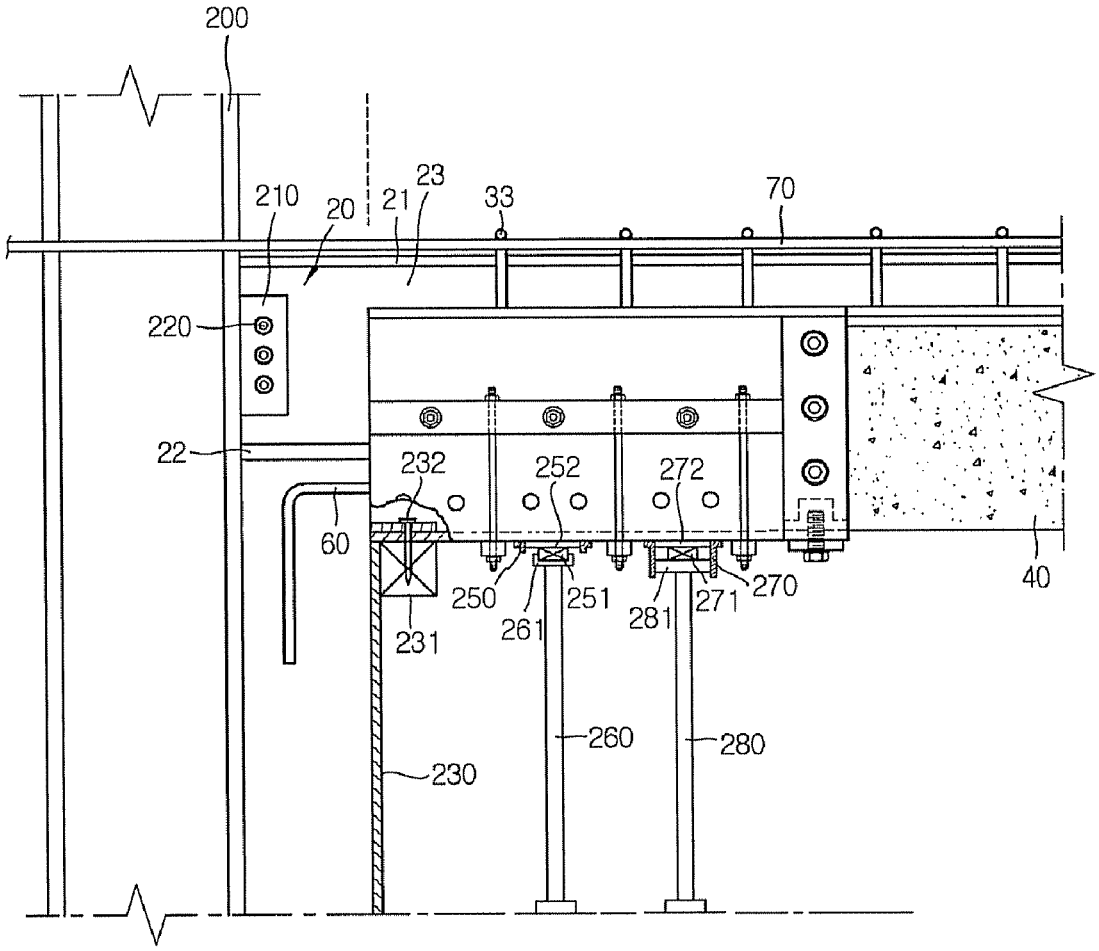

[Fig. 12]
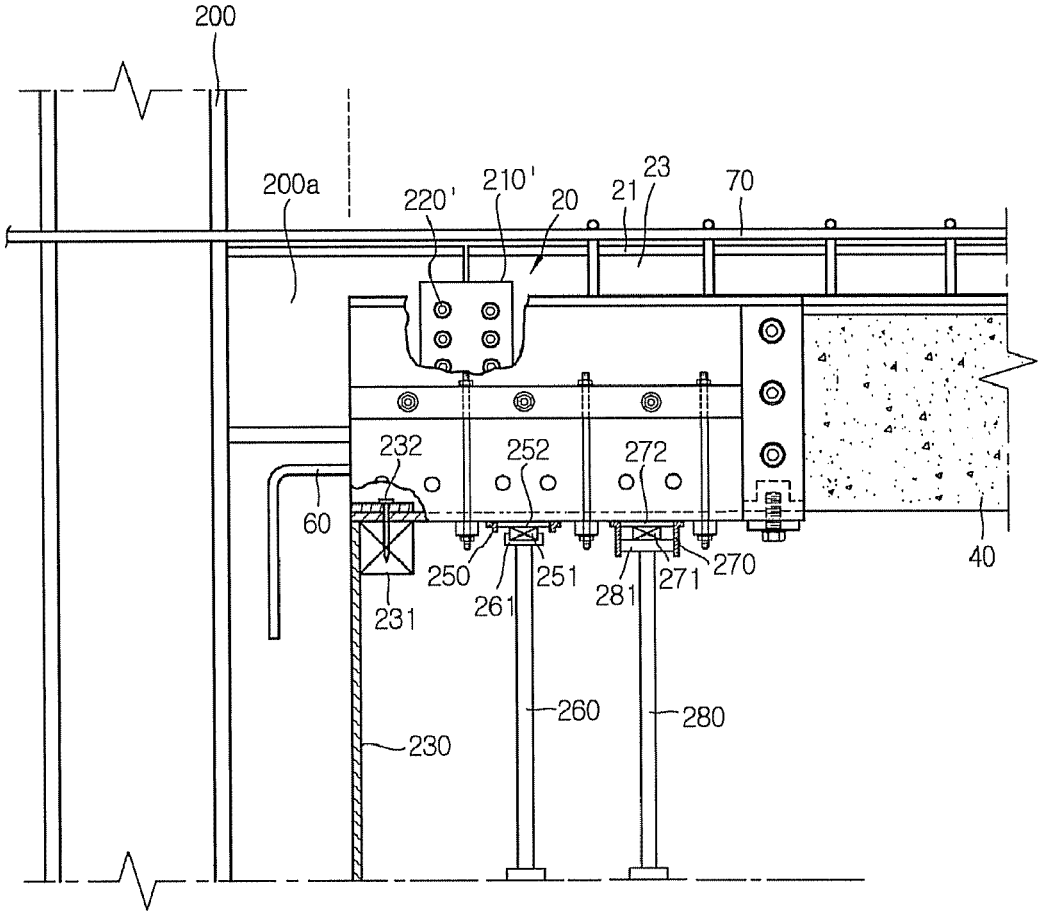

[Fig. 13]
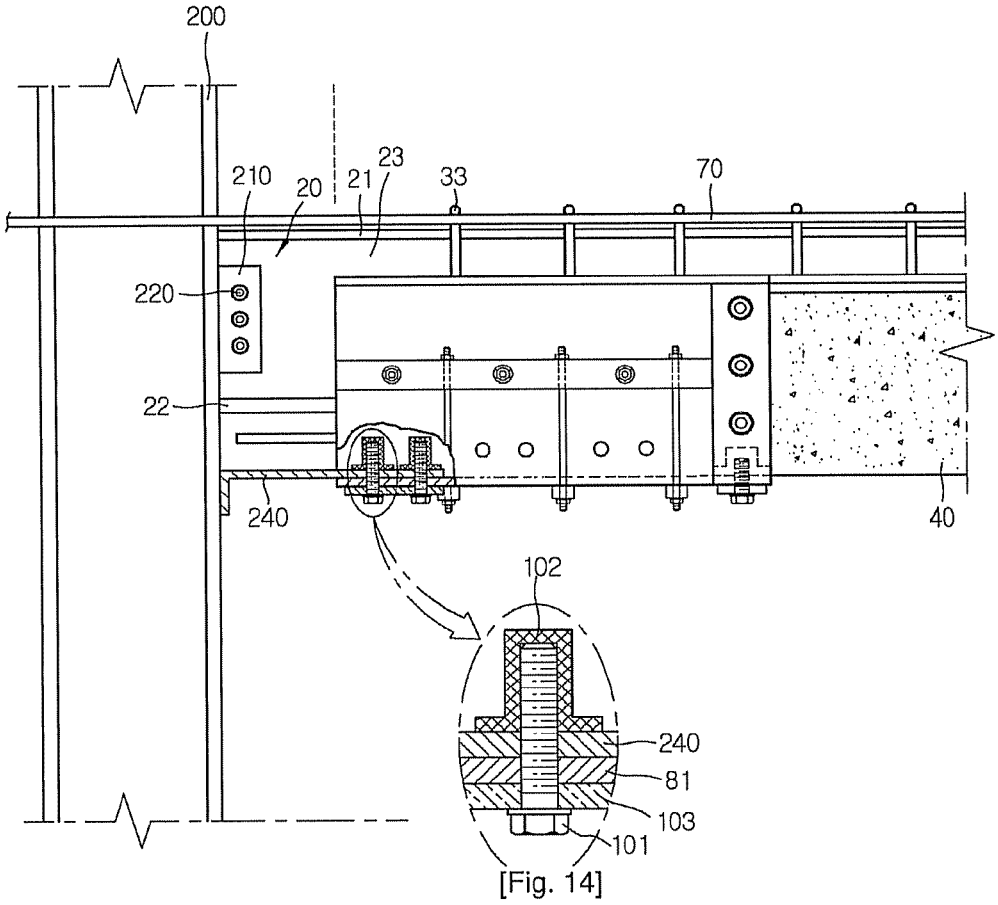
[Fig. 14]
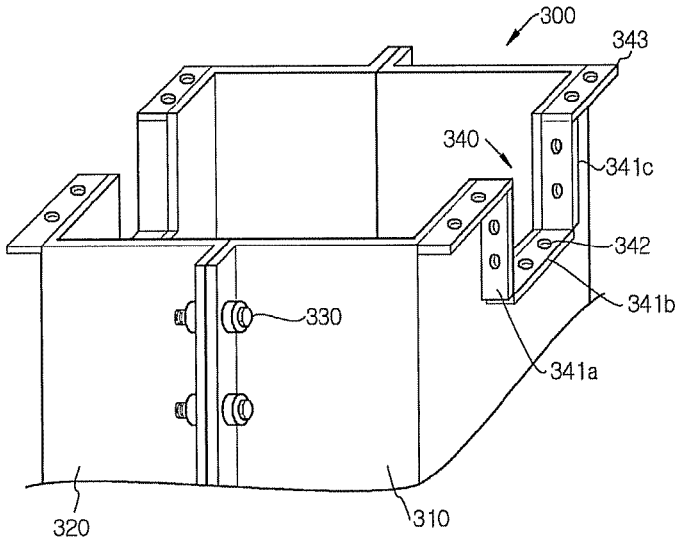

[Fig. 15]
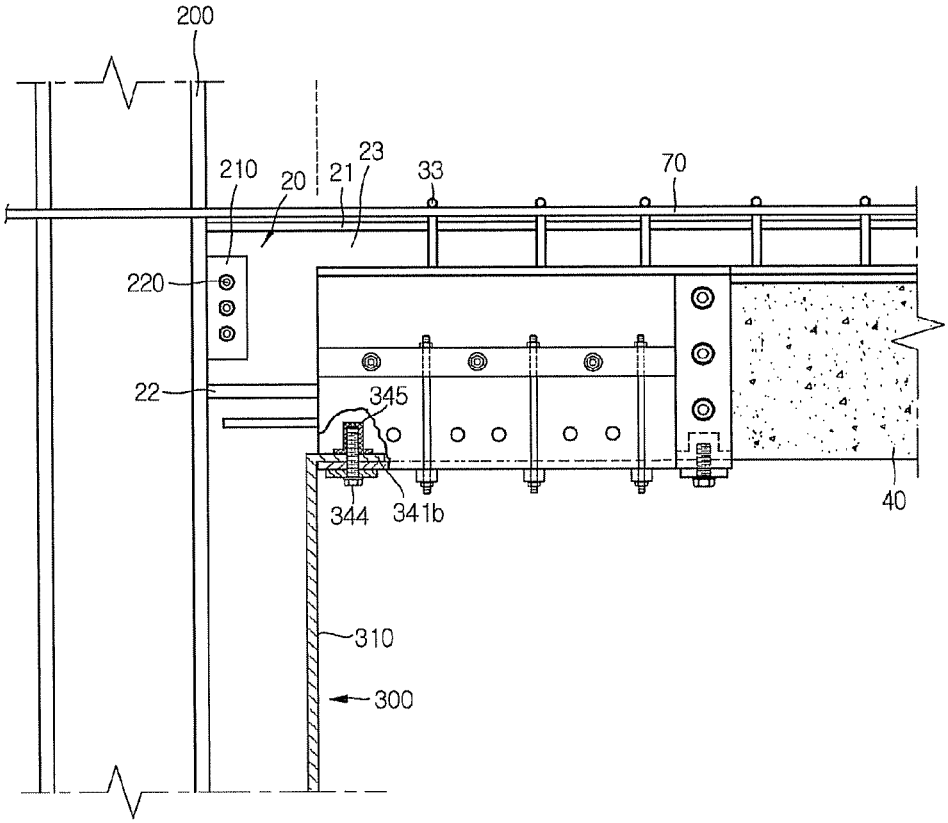
[Fig. 16]
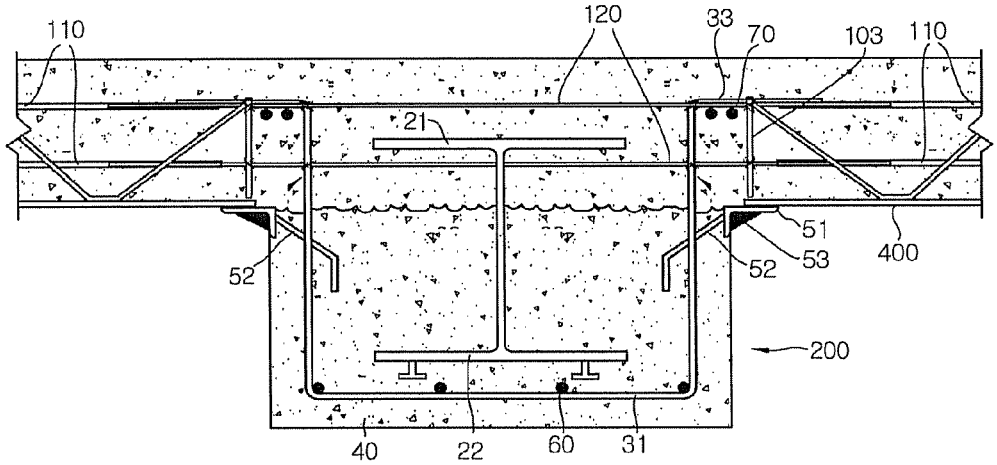

[Fig. 17]
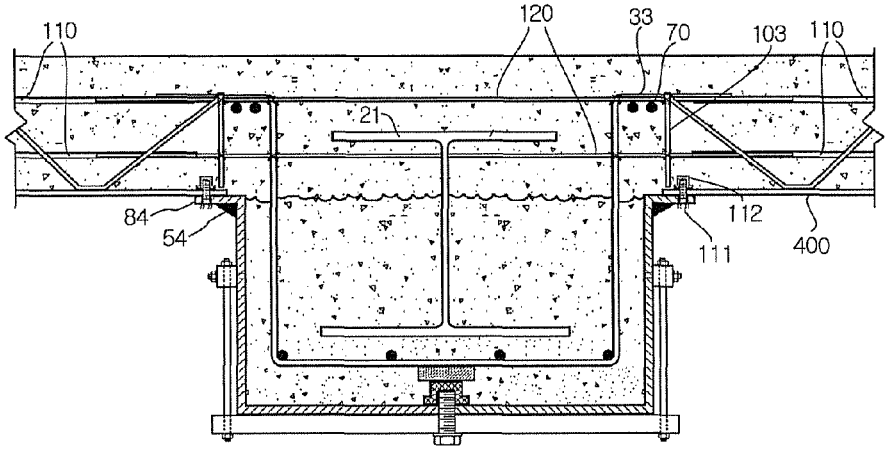
[Fig. 18]
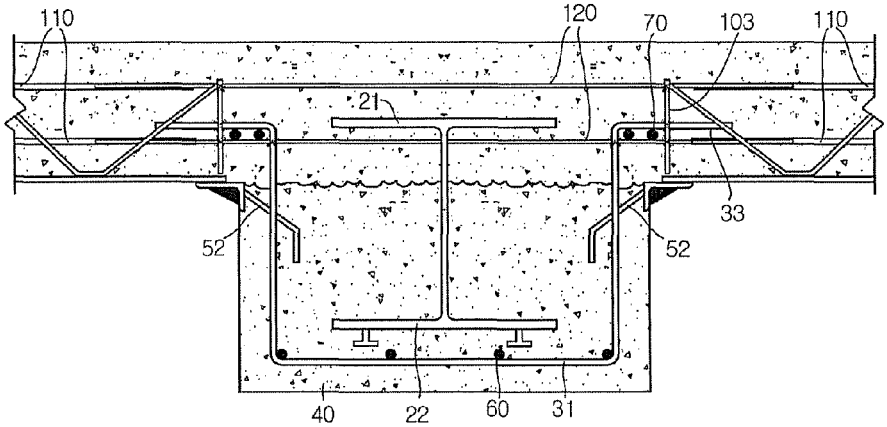
[Fig. 19]
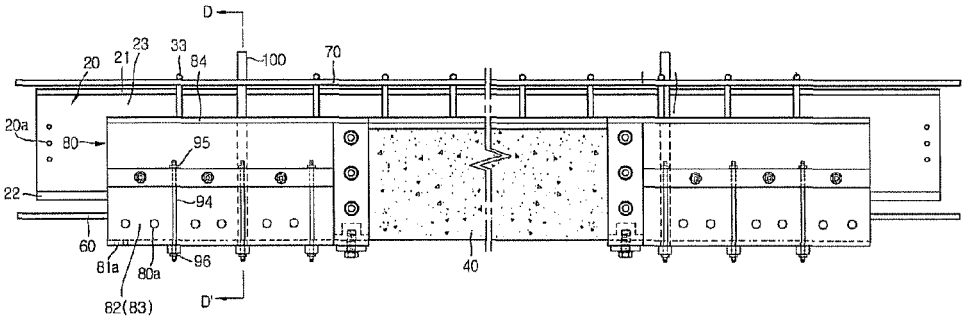

[Fig. 20]
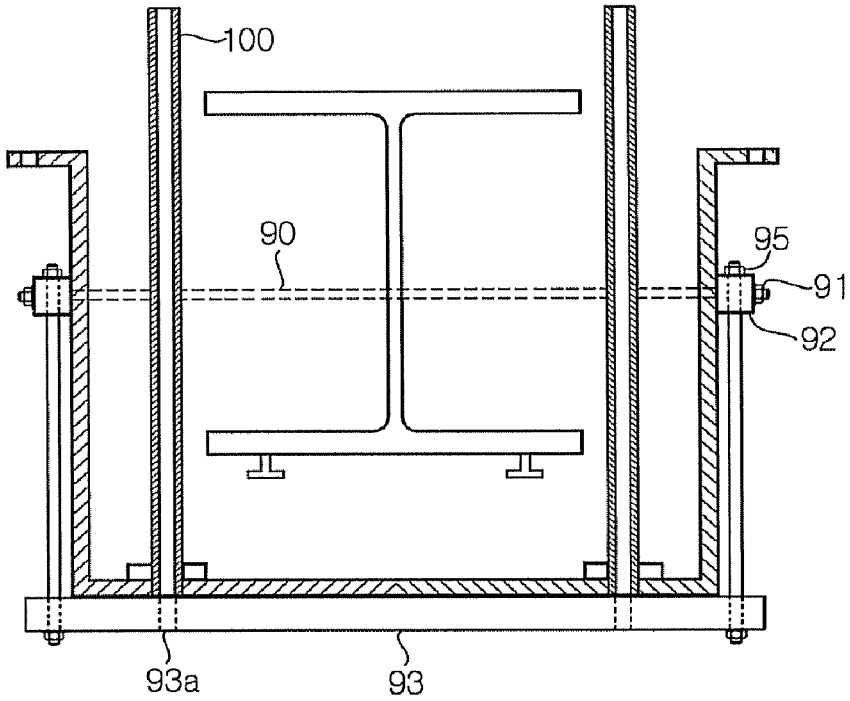

[Fig. 21]
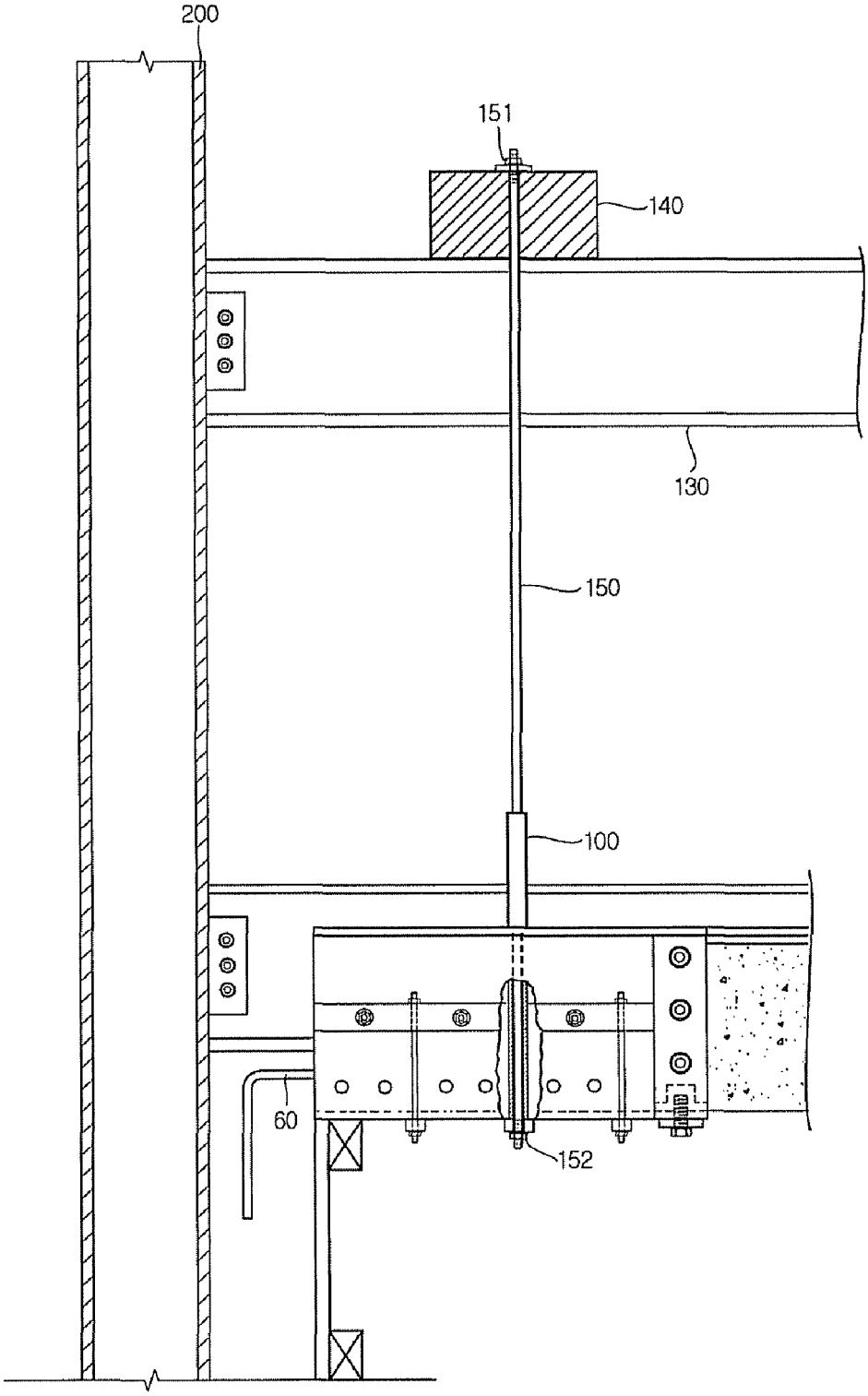

[Fig. 22]
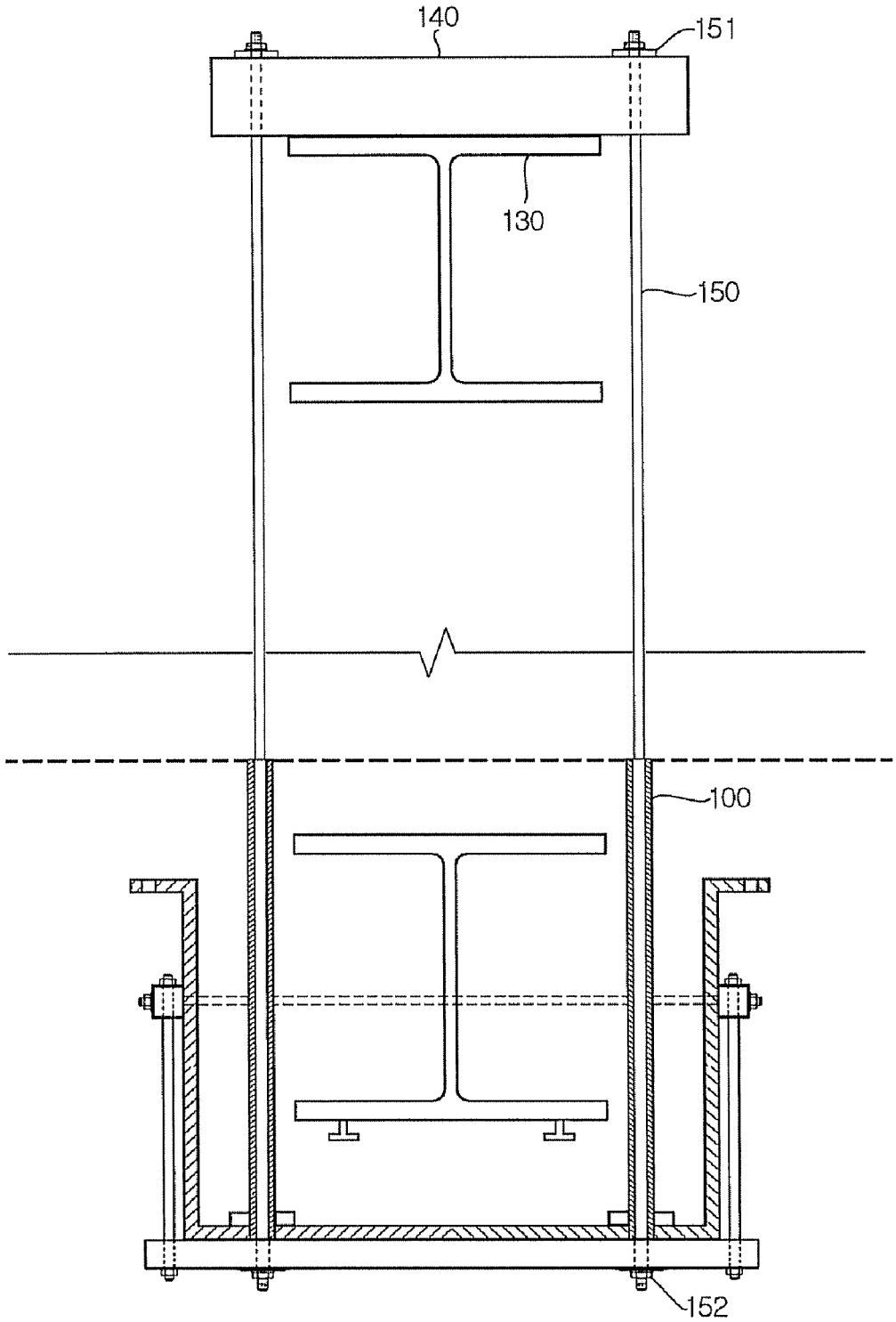

[Fig. 23]
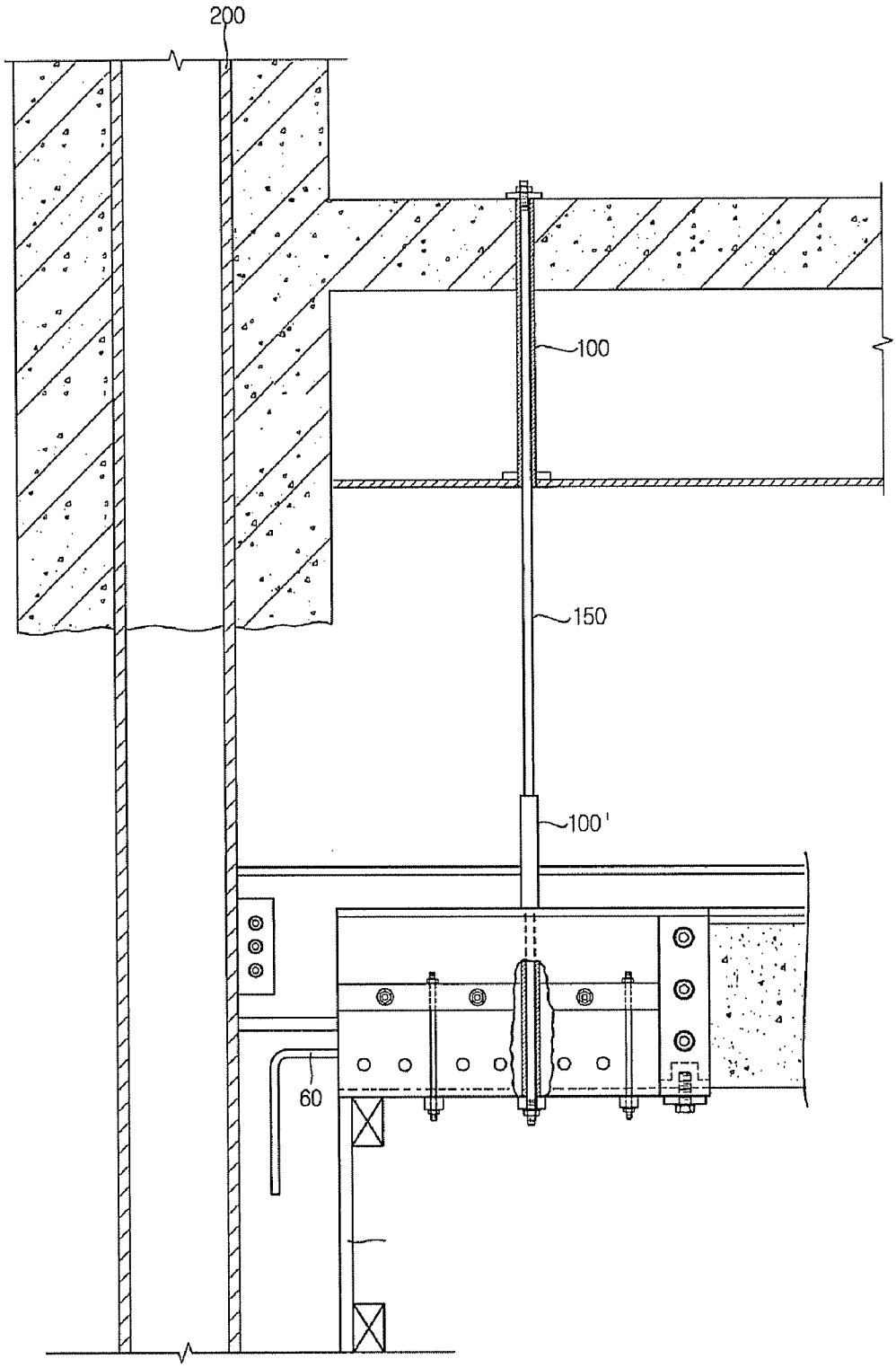

[Fig. 24]
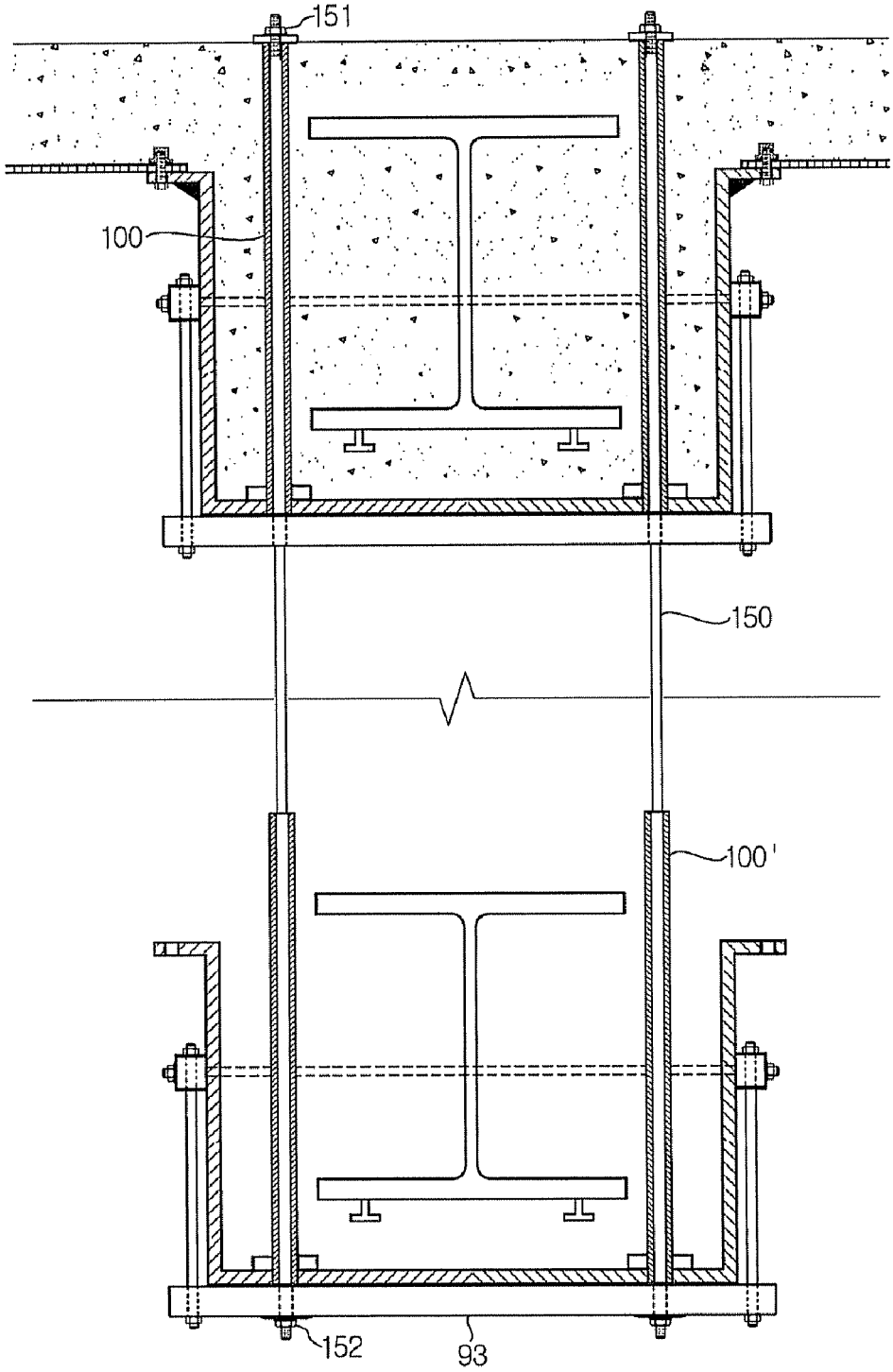

[Fig. 25]
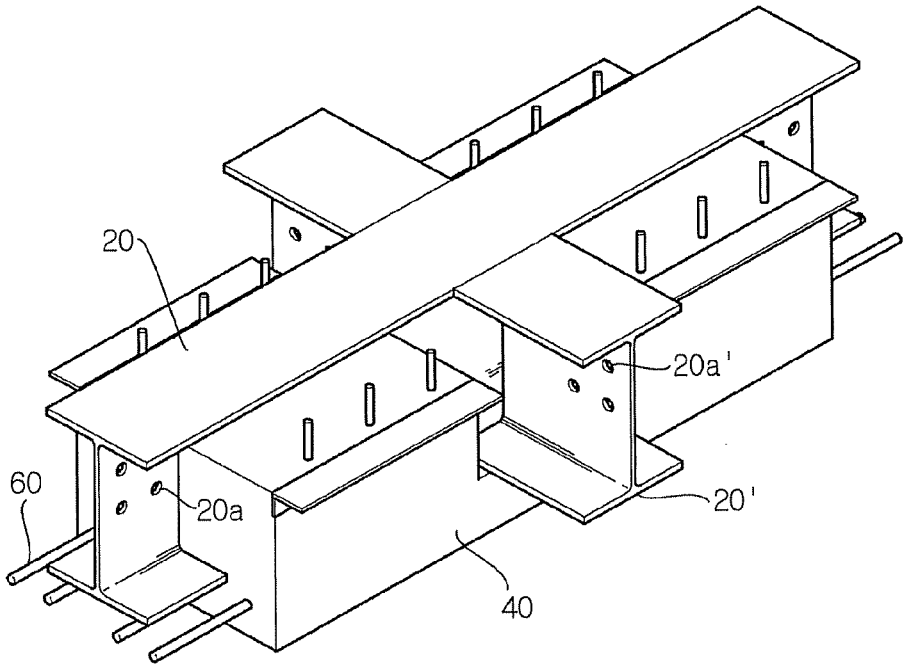
[Fig. 26]
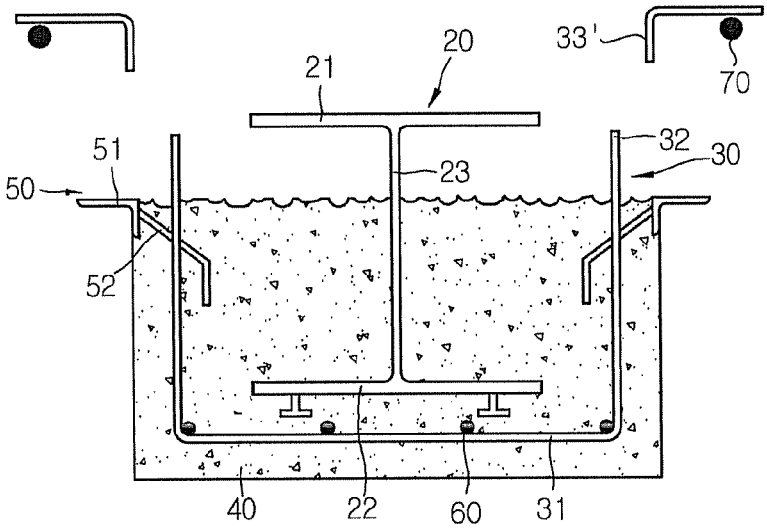

[Fig. 27]
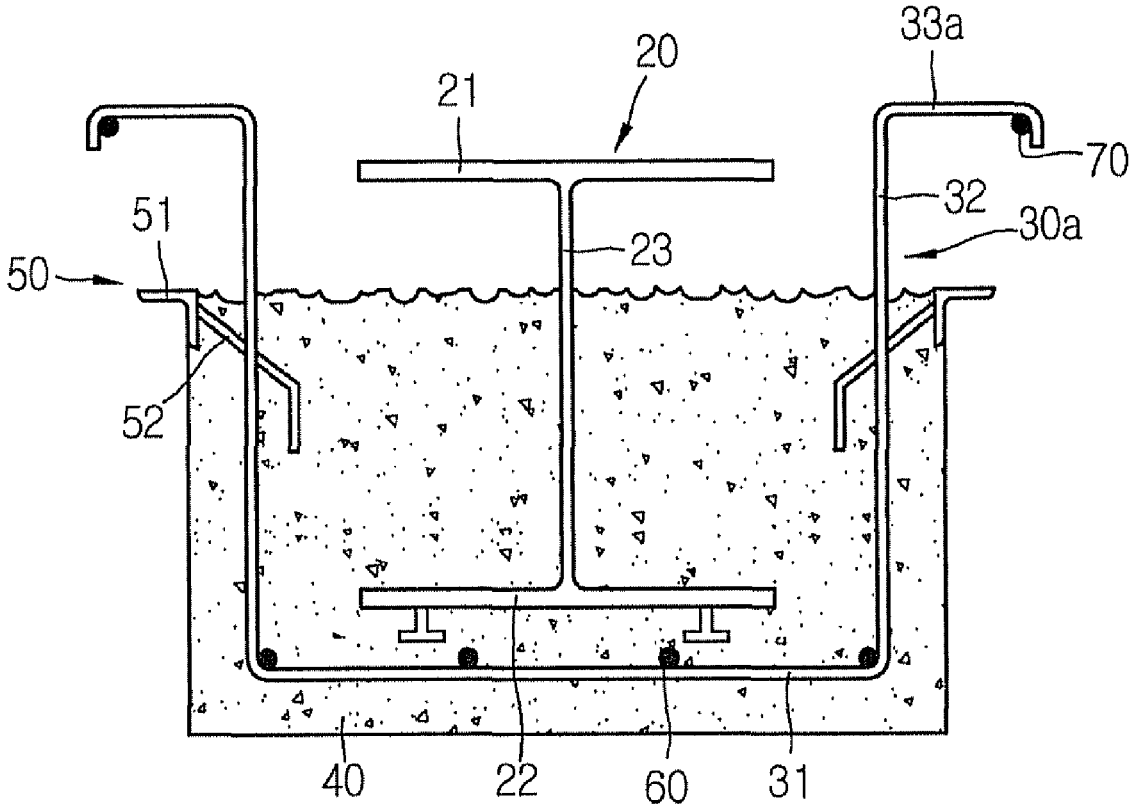
[Fig. 28]
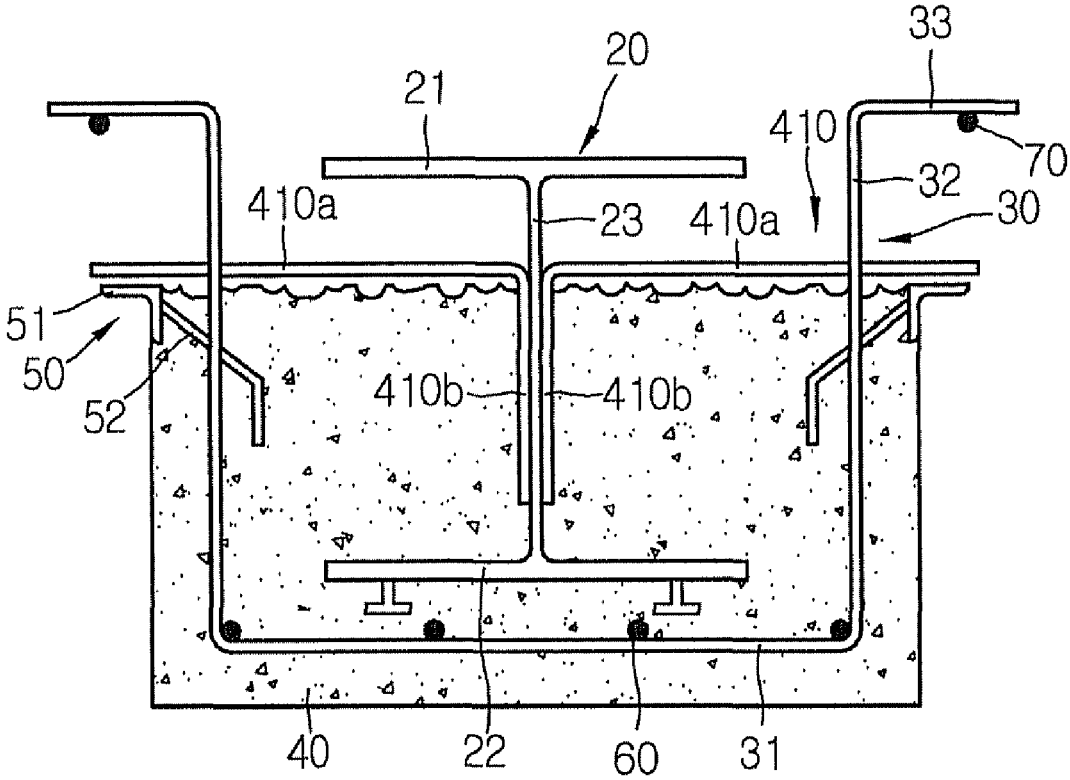

[Fig. 29]
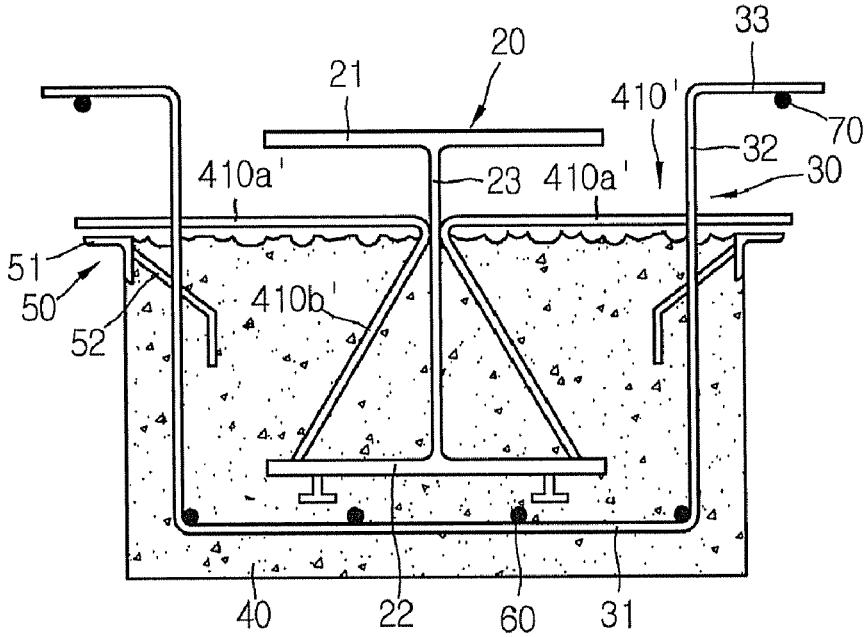
[Fig. 30]
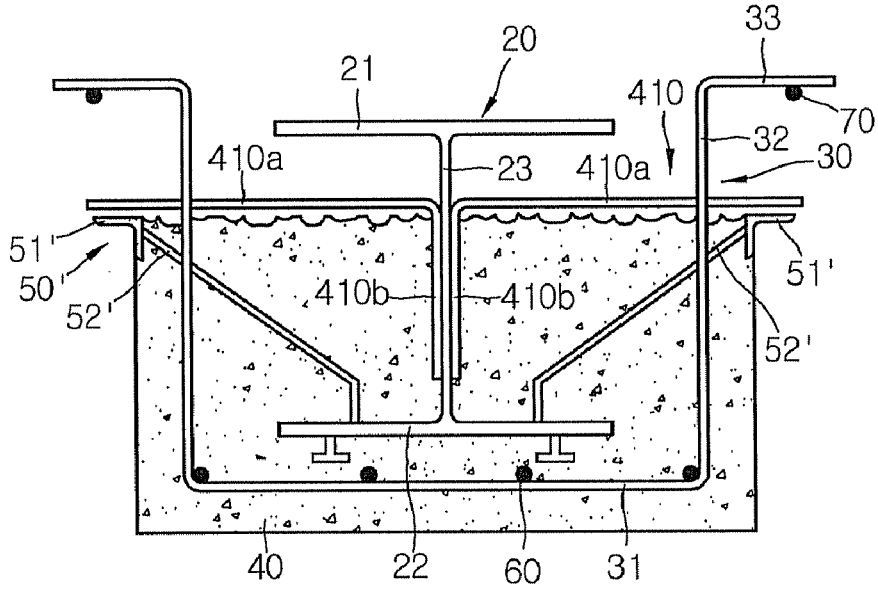

[Fig. 31]
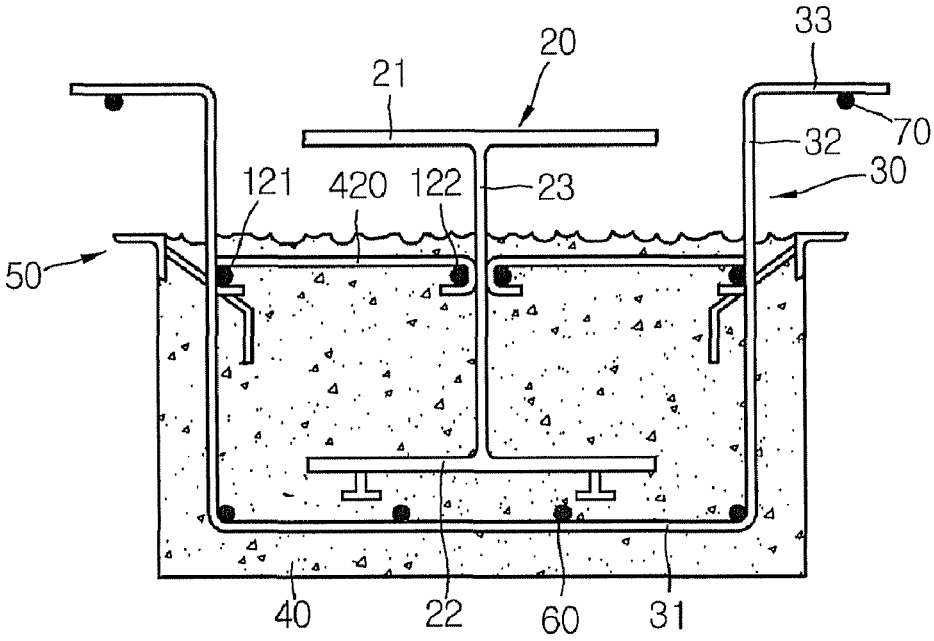
[Fig. 32]
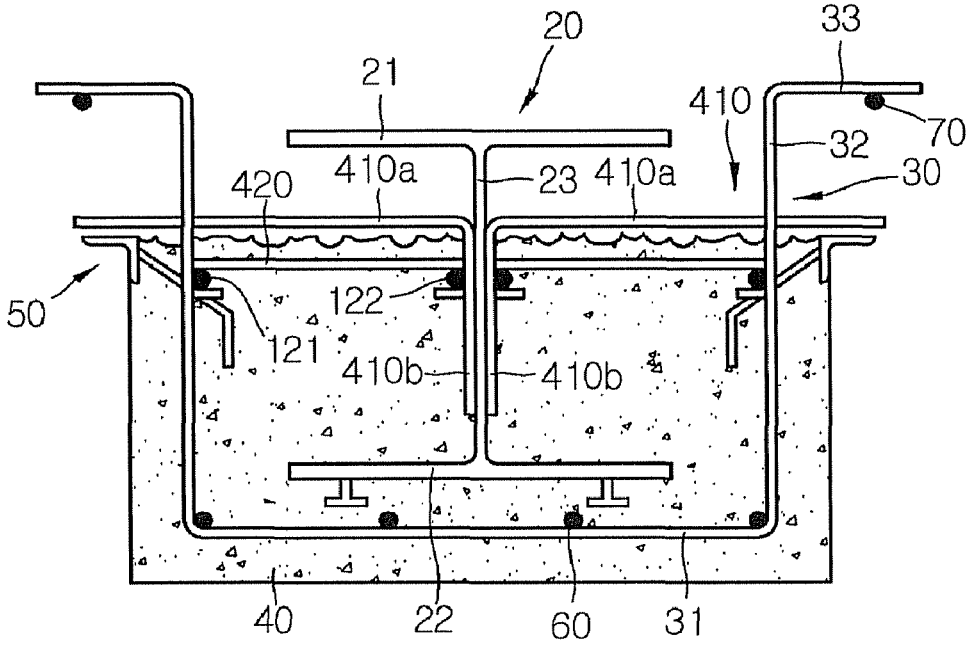

[Fig. 33]
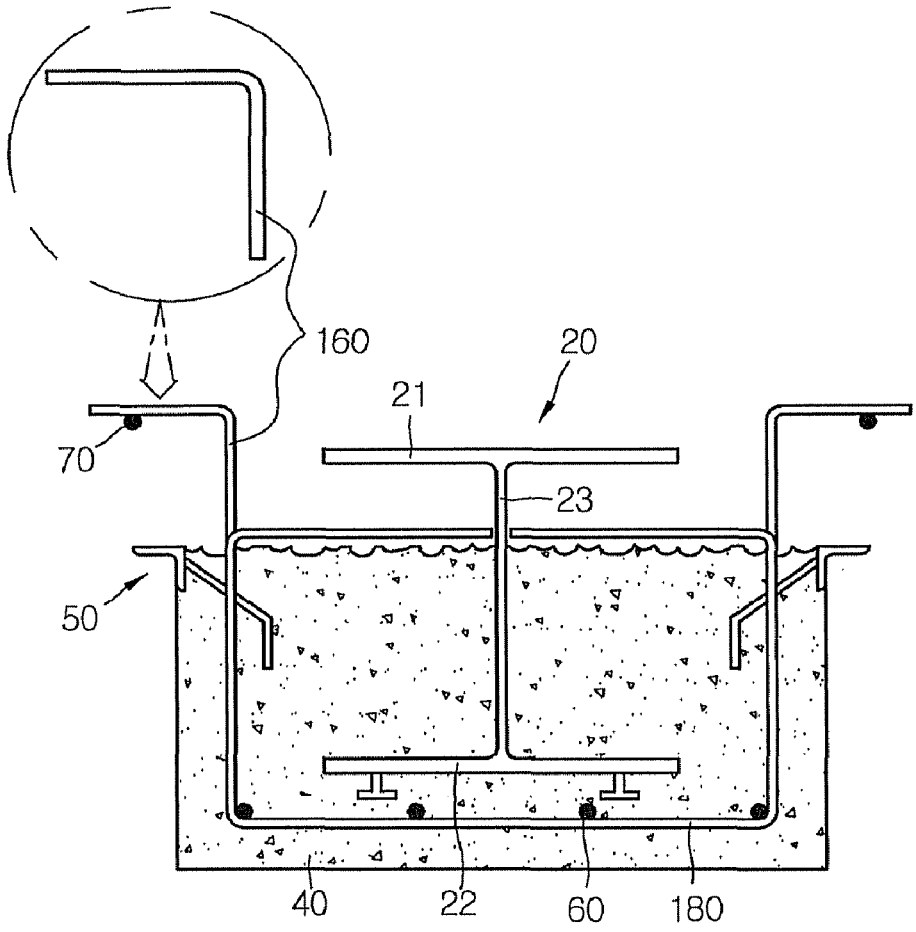
[Fig. 34]
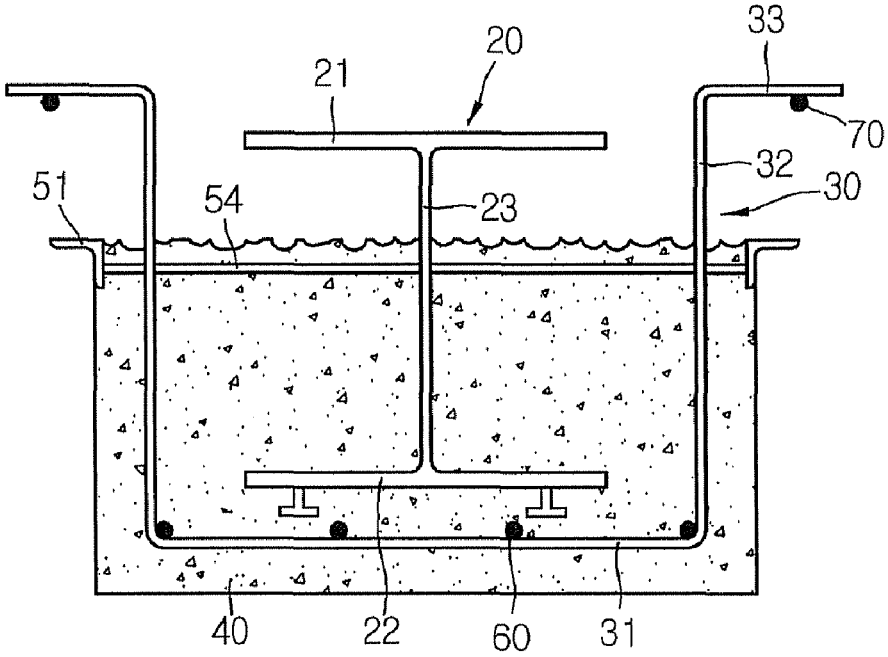

[Fig. 35]
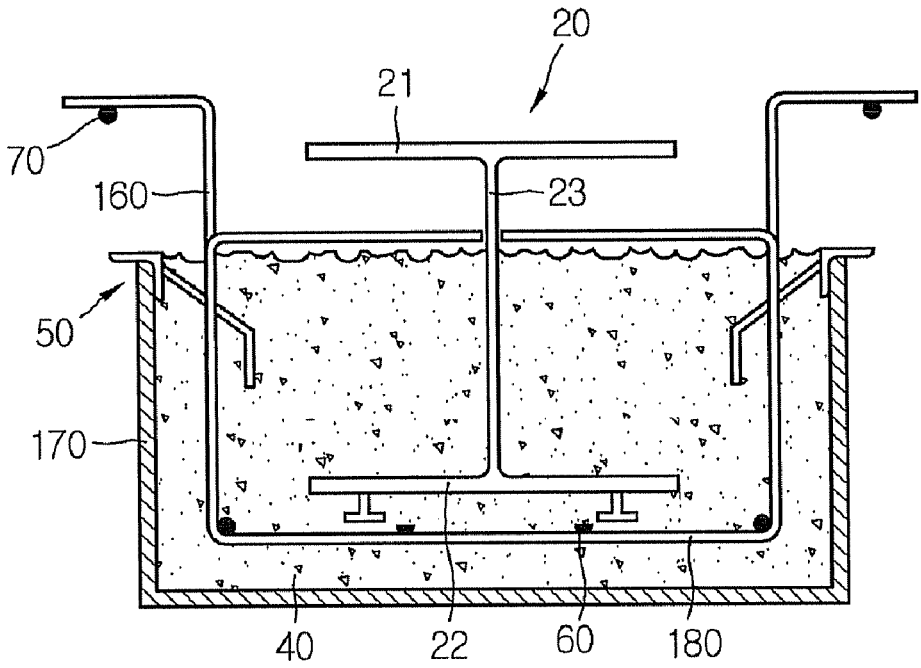
[Fig. 36]
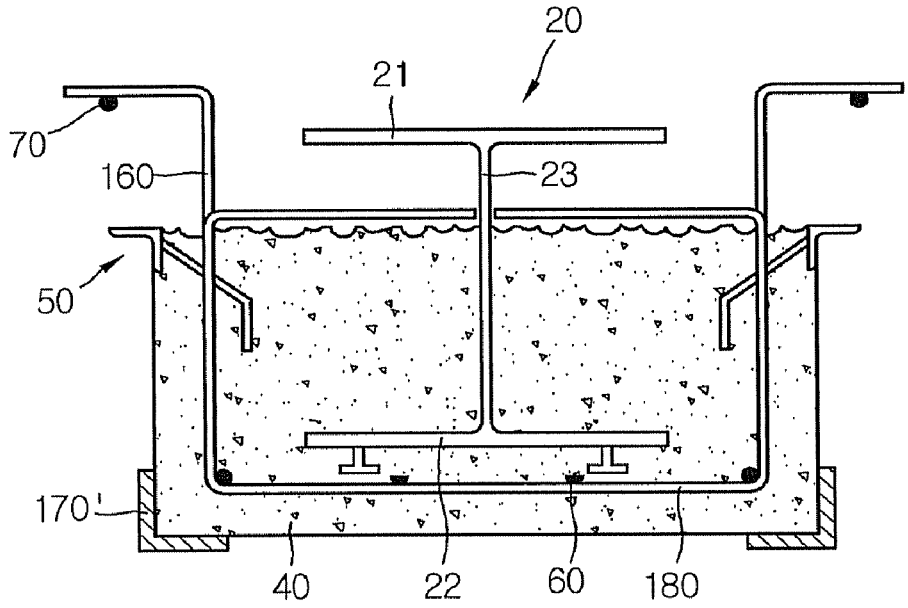

[Fig. 37]
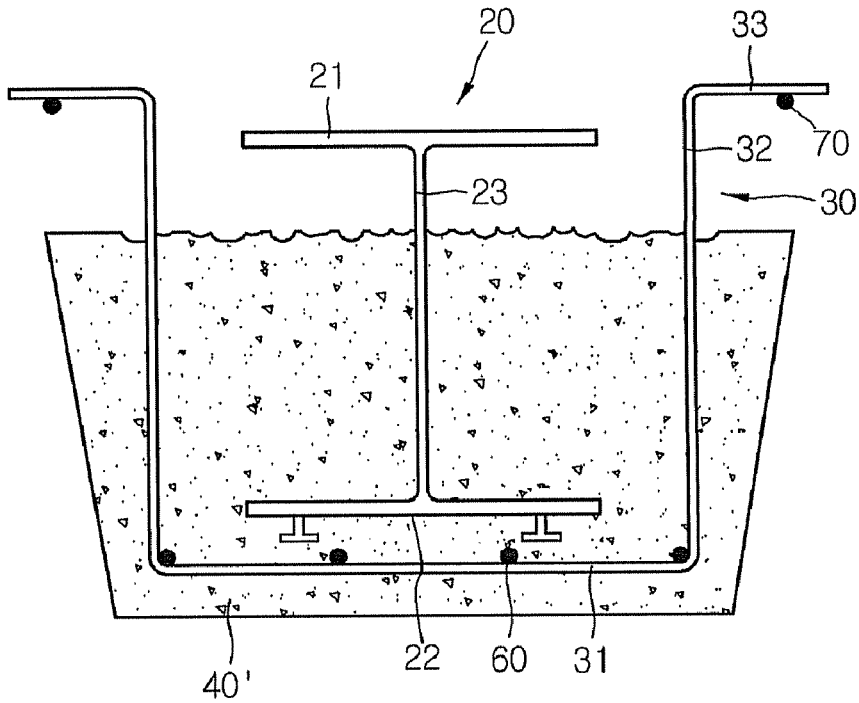
[Fig. 38]
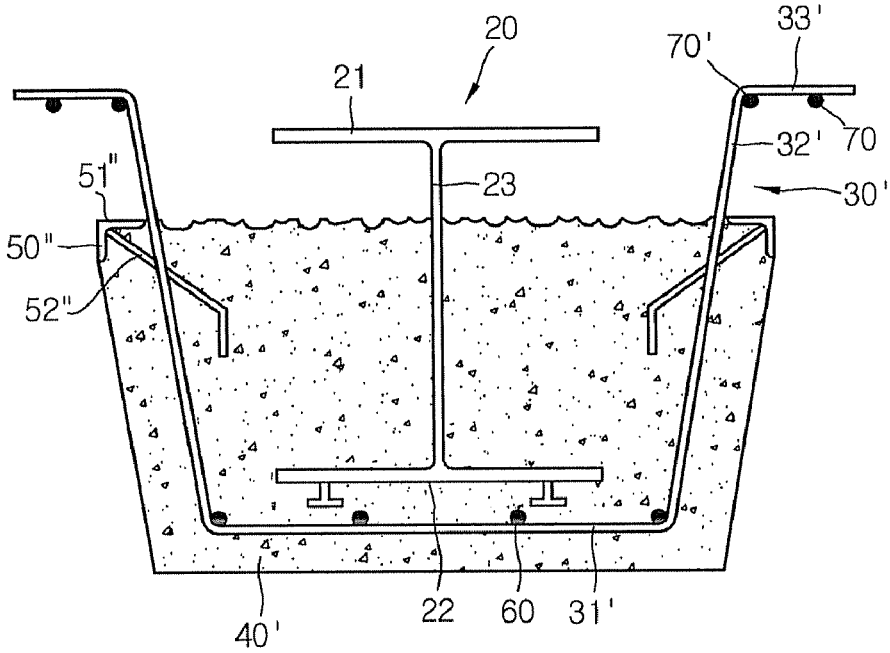

[Fig. 39]
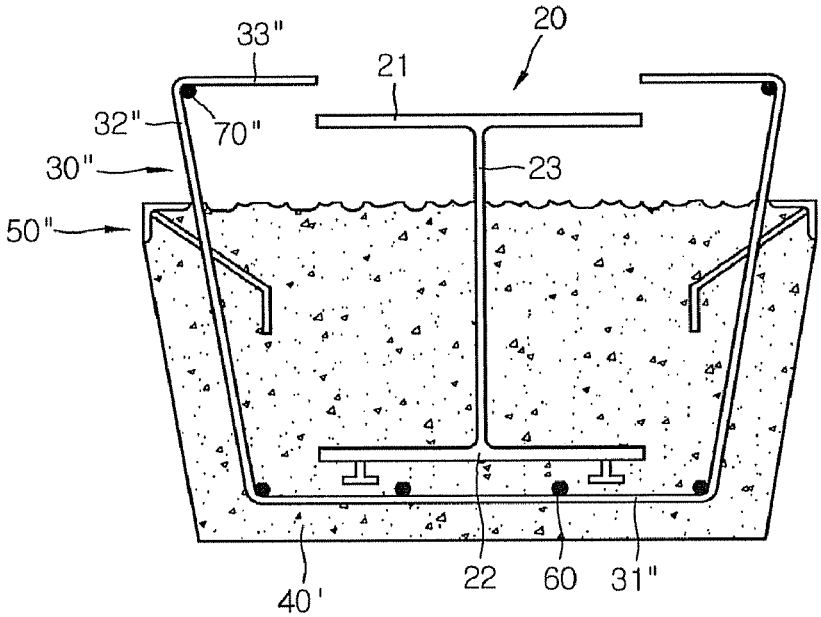
[Fig. 40]
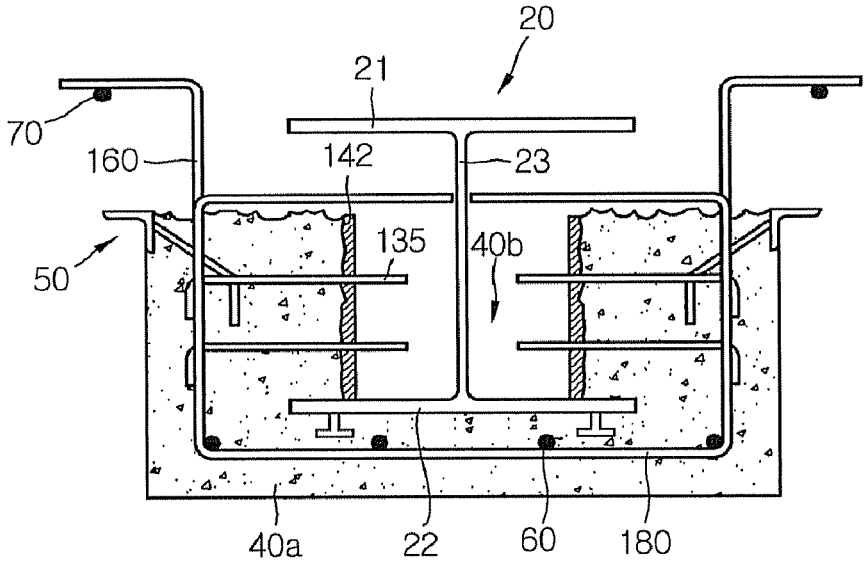

[Fig. 41]
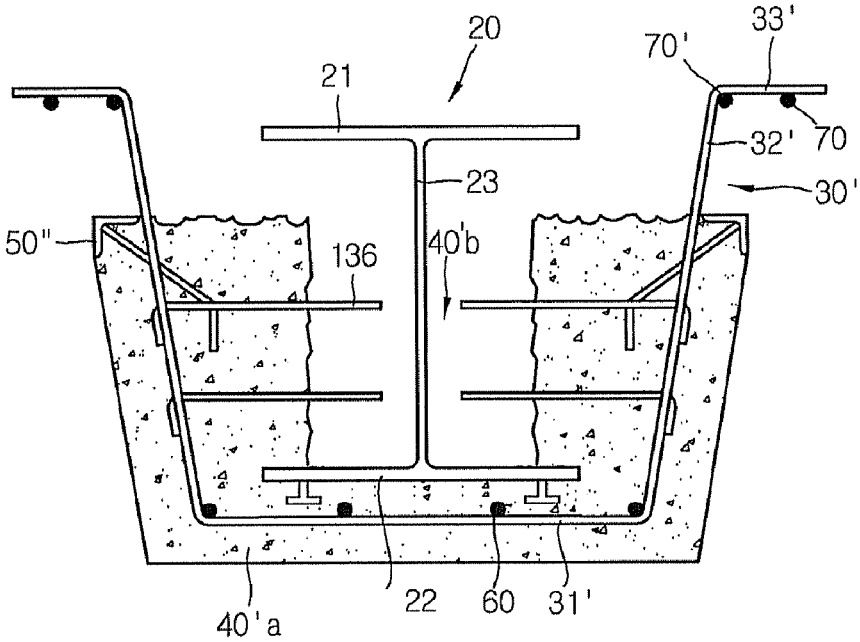
[Fig. 42]
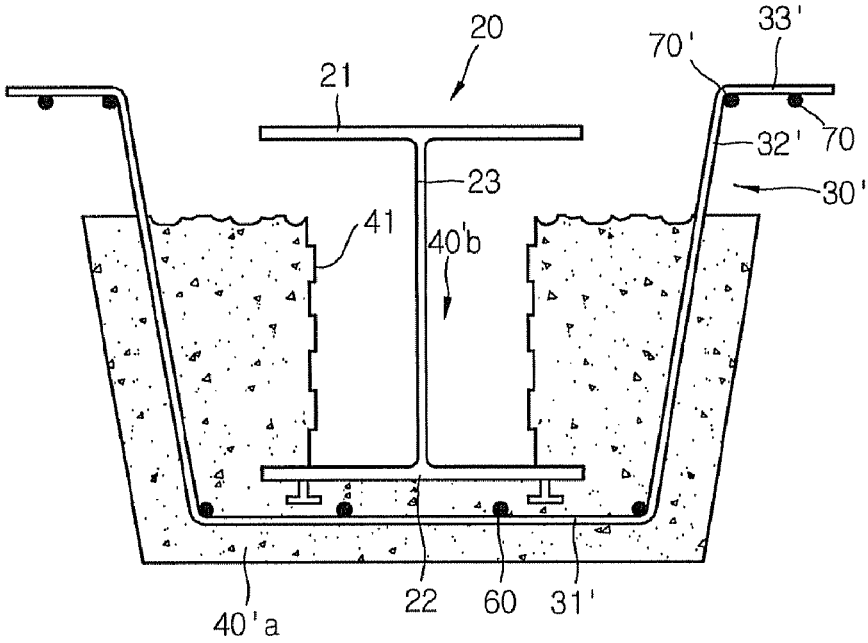

[Fig. 43]
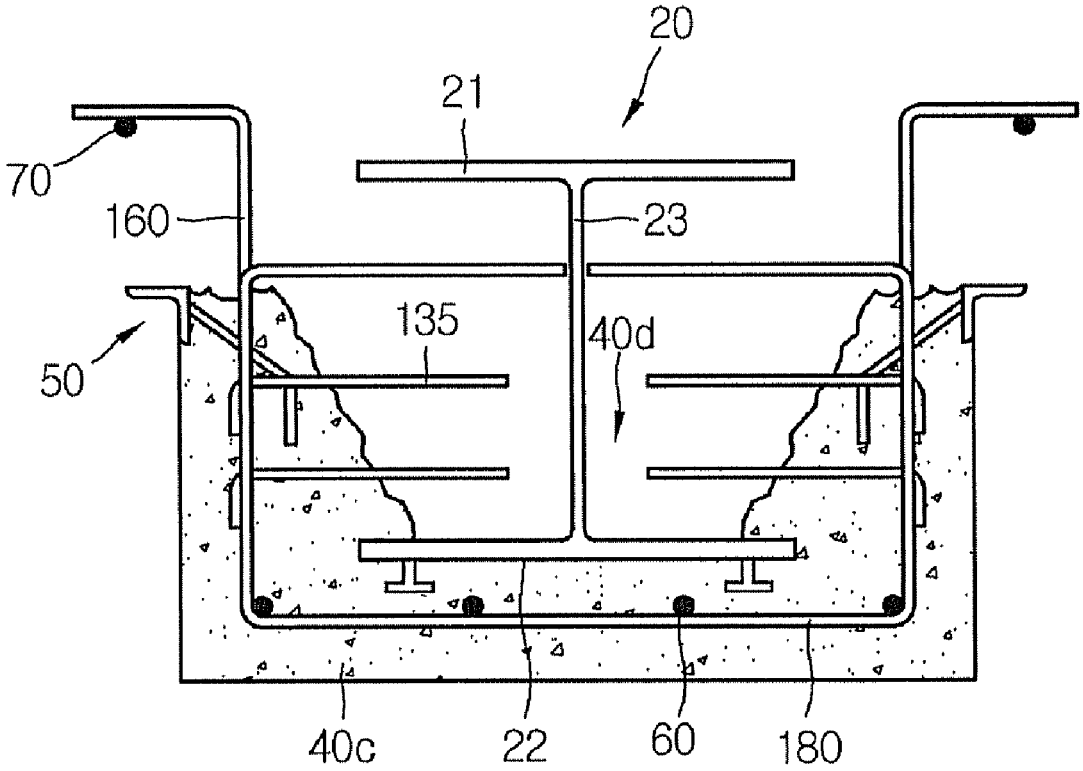
[Fig. 44]
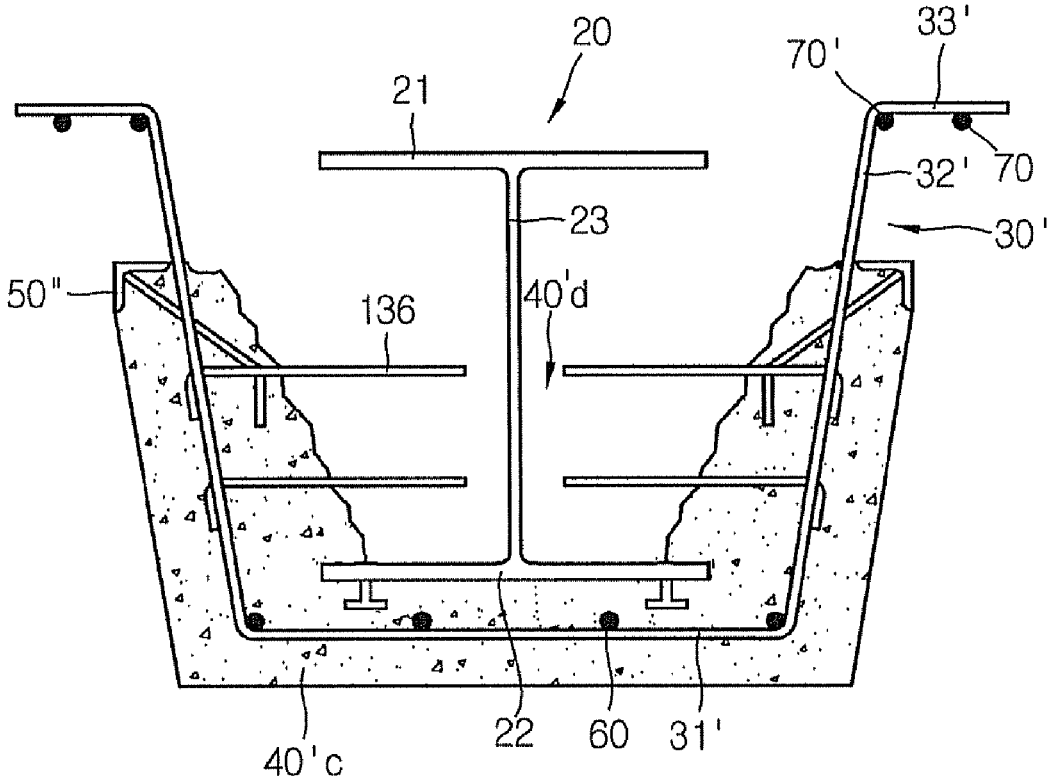

[Fig. 45]
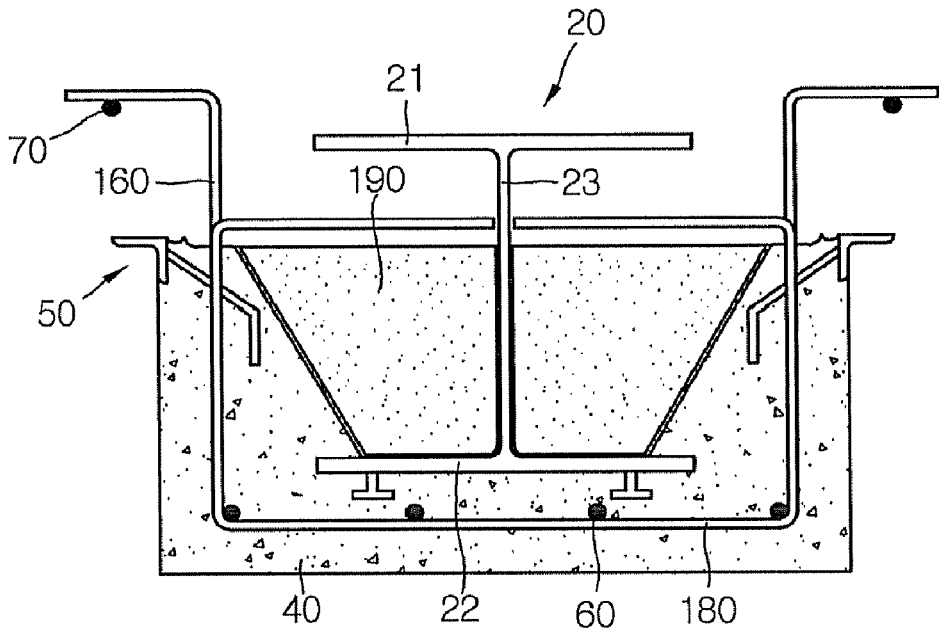
[Fig. 46]
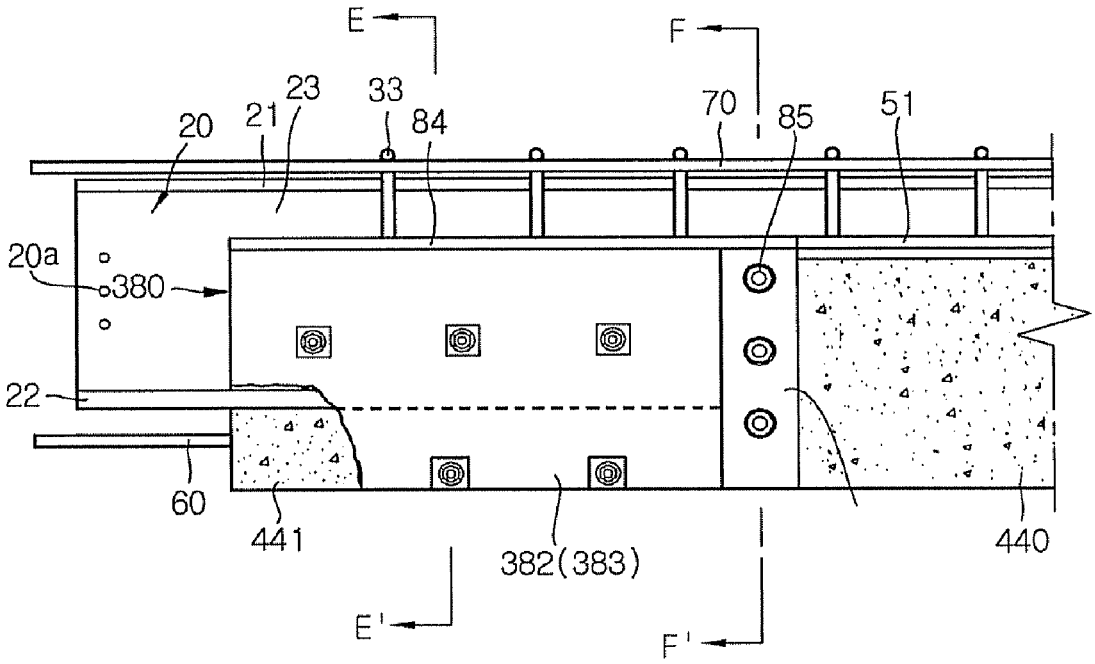

[Fig. 47]
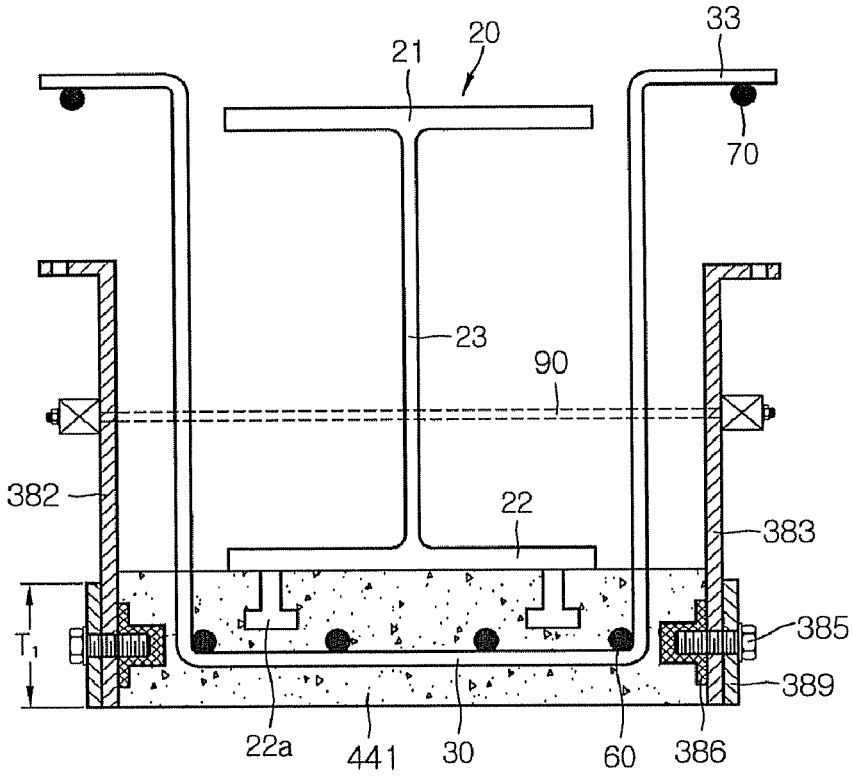
[Fig. 48]
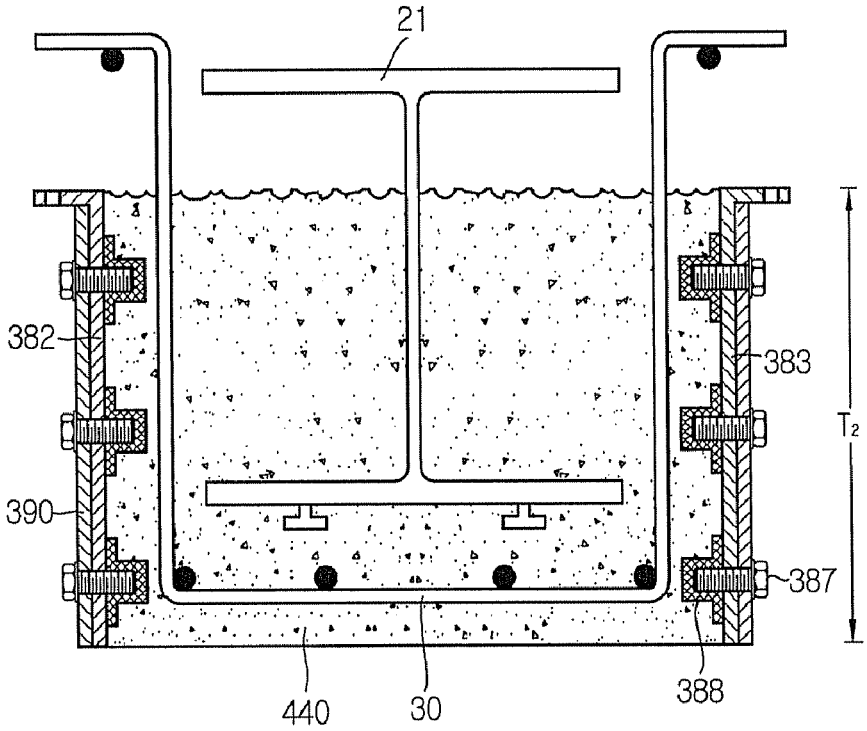

[Fig. 49]
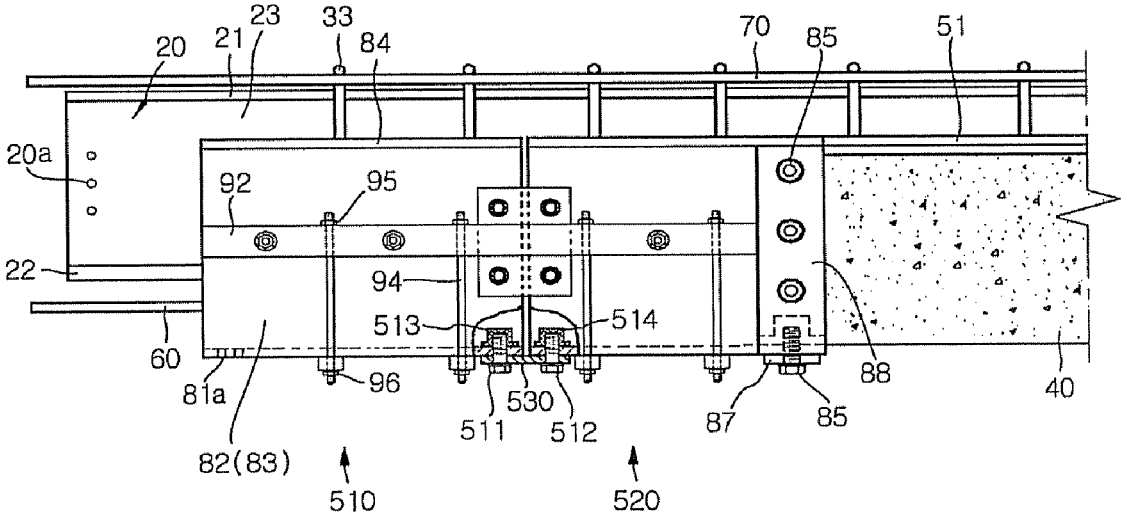
[Fig. 50]
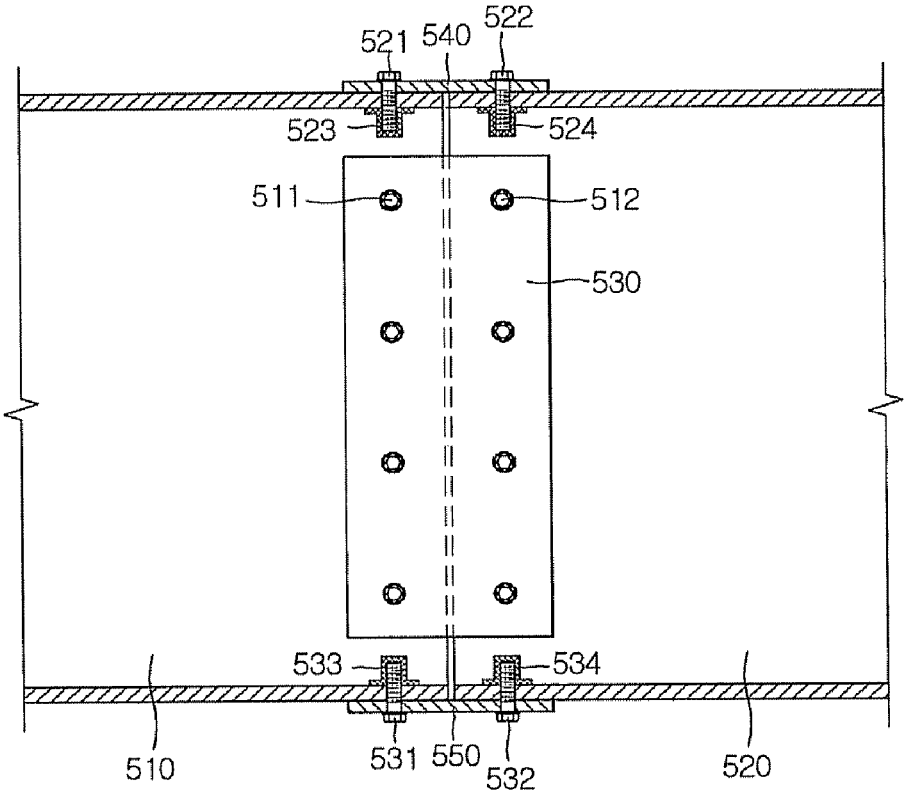

[Fig. 51]
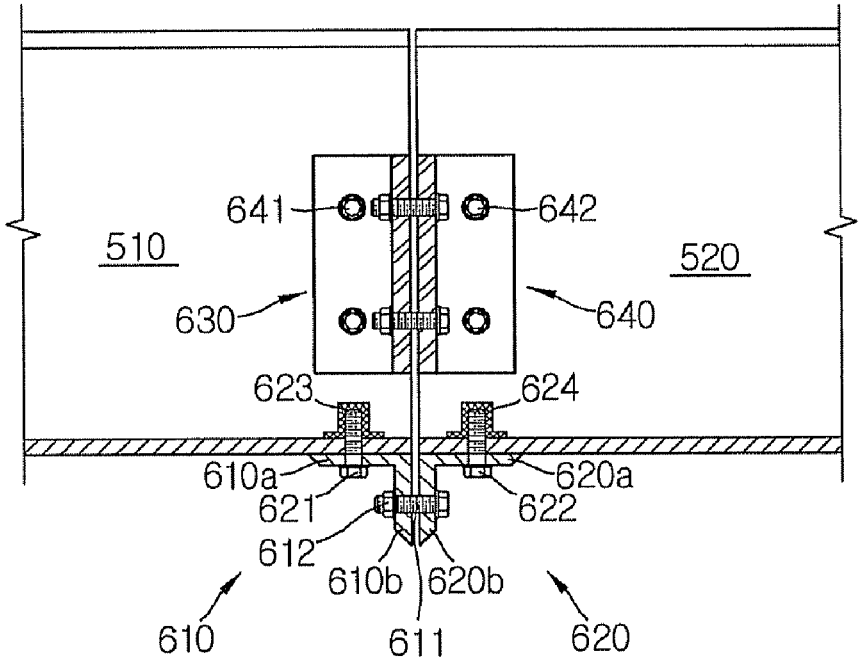
[Fig. 52]
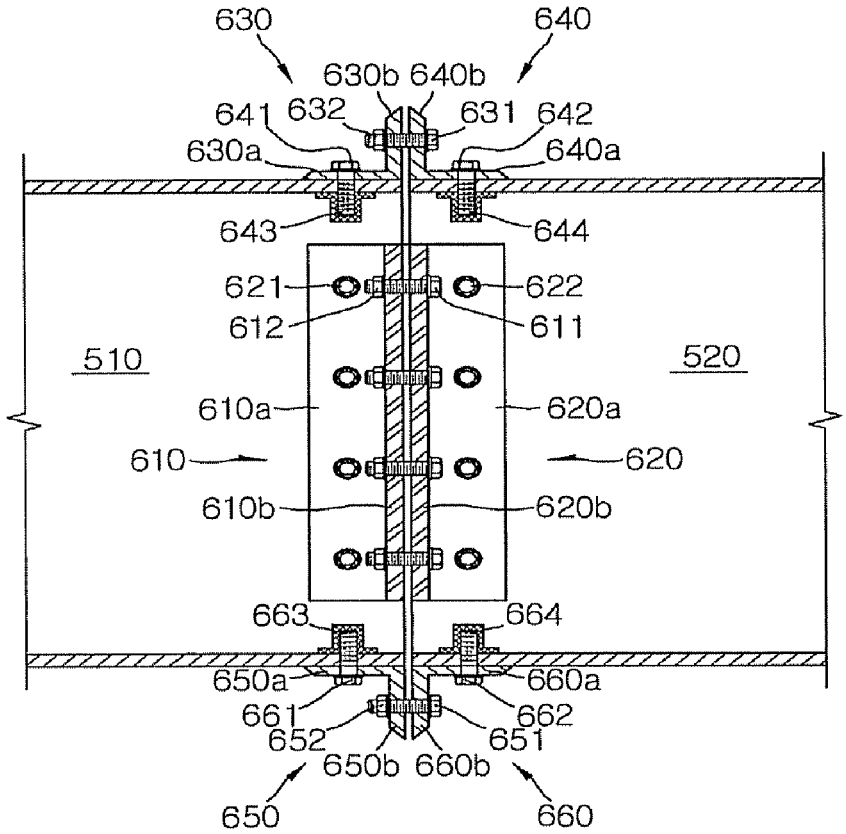

MOLD-CONCRETE COMPOSITE CROSSBEAM AND CONSTRUCTION METHOD USING THE SAME

CROSS-REFERENCE TO RELATED APPLICATIONS

This application claims the benefit of PCT International Patent Application No. PCT/KR2006/005231, filed Dec. 6, 2006, and Korean Patent Application No. 2005-118845, filed Dec. 7, 2005, in the Korean Intellectual Property Office, the disclosures of which are incorporated herein by reference.

TECHNICAL FIELD

The present invention relates to a mold-concrete composite crossbeam, and more particularly to a mold-concrete composite crossbeam capable of effectively resisting a bending moment and a compressive stress and integrally provided with a mold to effectively place concrete. The present invention also relates to a construction method using such a mold-concrete composite crossbeam.

BACKGROUND ART

Generally, a H-steel crossbeam is widely used for supporting floor or slab acting as the ceiling of each story of a building. That is to say, as shown in FIG. 1, a H-steel crossbeam 12 and a slab 11 configure a slab structure 10.

Meanwhile, the height of each story of the building is equal to the sum of the height of a room space and the height of the slab structure 10. That is to say, as the height of the slab structure 10 is reduced, the height of each story may be decreased. Thus, as the height of the slab structure 10 is small, the height of a story is reduced in spite of the same story number, thereby reducing a construction cost.

The height H of the slab structure 10 is equal to the sum of the height H1 of a H-steel crossbeam 12 and the height H2 of a slab 11. If the height H1 of the H-steel crossbeam 12 or the height H2 of the slab 11 is decreased to reduce the height H of the slab structure 10, the slab structure 10 becomes weaker in its supporting force or bending resistance, which influences on the safety of the structure. Here, the reference numeral 11*a* designates a steel bar installed to the slab 11.

In addition, if the size of the H-steel crossbeam 12 is decreased to reduce the height H of the slab structure 10, the sectional area of the H-steel crossbeam is also decreased, thereby making the H-steel crossbeam weakened against a compressing force and a bending momentum.

In order to solve the above problems, a method for installing a deck plate 14 having a groove 14*a* corresponding to an upper flange 12*a* of the H-steel crossbeam 12 to the H-steel crossbeam 12, and then placing concrete thereto to make a slab structure 15, as shown in FIG. 2, was proposed.

The slab structure 15 advantageously reduces its height as much as the depth of the groove 14*a*. This slab structure 15 may effectively endure the stress applied in a vertical direction A to the slab 13, but regarding the stress applied in a direction B parallel to the slab 13, a shear stress and a bending momentum are greatly concentrated in a region near the groove 14*a* since the thickness of the slab 13 is small in the region, and also the slab structure 15 is weak against a compressing force.

FIG. 3 is a sectional view showing a slab structure 19 including a stand 16 welded to a web 12*b* of the H-steel crossbeam 12, and a deck plate 17 installed to the stand 16. That is to say, the slab structure is configured in a way of welding the stand 16 to the web 12*b* for installation, installing the deck plate 17 on the stand 16, and then placing concrete thereto so that a predetermined portion of the H-steel crossbeam 12 is buried in the concrete.

This slab structure 19 is structurally stable in comparison to the slab structure of FIG. 2. However, the slab structure 19 is disadvantageous in that a process for welding the stand 16 to the web 12*b* is additionally required, and the structure may have seriously bad stability if the welding portion between the stand 16 and the web 12*b* is not firm.

In addition, in the above slab structures, H-steel is weak against fire since it is exposed outward. That is to say, high temperature caused by the fire may be directly transferred to the H-steel, which may cause deformation of the H-steel. In order to prevent this problem, the exposed H-steel should be coated with heat-resisting material.

Meanwhile, when constructing beams and slabs in the conventional art, H-steel is connected between columns, and then a mold is installed to surround them. Thus, it causes delay of construction process and economic loss in installing the mold and also removing the mold after casting.

DISCLOSURE OF INVENTION

Technical Problem

The present invention is designed in consideration of the above problems, and therefore it is an object of the invention to provide a mold-concrete composite crossbeam capable of effectively reducing the height of story by decreasing the height of a slab structure without causing any bad influence on the safety of a building.

Another object of the present invention is to provide a mold-concrete composite crossbeam capable of effectively resisting a bending momentum and a compressive stress applied to a building.

Still another object of the present invention is to provide a mold-concrete composite crossbeam that does not require any separate heat-resistance coating or corrosion-resistance coating on a H-steel.

Further another object of the present invention is to provide a mold-concrete composite crossbeam integrally provided with a mold so that concrete may be effectively placed.

Technical Solution

In order to accomplish the above object, the present invention provides a mold-concrete composite crossbeam, comprising: a H-steel composed of an upper flange, a lower flange, and a web connecting the upper and lower flanges to each other; a concrete member formed in a length direction of the H-steel so that the upper flange of the H-steel is exposed out but the lower flange and the web are at least partially buried therein; deck plate supports installed to both side edges of an upper surface of the concrete member so as to support a deck plate placed thereon; a reinforcing steel bar installed around the H-steel; a mold including a bottom detachably coupled to a lower end surface of the concrete member, and a pair of sidewalls formed in parallel to both sides of the bottom and detachably coupled to both end sides of the concrete member; a lateral reinforcing member coupled across both sidewalls of the mold to support the sidewalls; a side reinforcing member installed to an outer side of the sidewalls of the mold in a length direction thereof; and a plurality of bottom reinforcing members installed across a lower surface of the bottom of the mold to support the lower surface.

Preferably, a plurality of buried nuts for preventing contact with concrete are provided to an end of the concrete member, and coupling bolts are inserted into a plurality of coupling holes formed in the mold and coupled to the buried nuts so as to fix the mold to the concrete member.

More preferably, extension support units extended outward in both side directions are formed on upper edges of the sidewalls of the mold to support the deck plate.

In one embodiment, the reinforcing steel bar includes a plurality of stirrup steel bars installed in a length direction of the H-steel at regular intervals to surround at least a part of the H-steel; and a plurality of tension/compression steel bars installed in parallel in a length direction of the H-steel.

In another aspect of the present invention, there is also provided a mold-concrete composite crossbeam, comprising: a H-steel composed of an upper flange, a lower flange and a web connecting the upper flange and the lower flange; a main concrete member formed in a length direction of the H-steel and having a thickness ($T_2$) that exposes the upper flange of the H-steel out buries the lower flange and at least a part of the web therein, and a sub concrete member continuously extended from an end of the main concrete member and having a thickness ($T_1$) relatively smaller than the main concrete member; deck plate supports installed to both side edges of an upper surface of the concrete member so as to support a deck plate placed thereon; a reinforcing steel bar installed around the H-steel; a mold including a bottom detachably coupled to a lower end surface of the concrete member, and a pair of sidewalls formed in parallel to both sides of the bottom and detachably coupled to both end sides of the concrete member; a mold including a pair of sidewalls detachably coupled to both end sides of the main concrete member and both sides of the sub concrete member; a lateral reinforcing member coupled across both sidewalls of the mold to support the sidewalls; and a side reinforcing member installed to an outer side of the sidewalls of the mold in a length direction thereof.

Preferably, the reinforcing steel bar includes a plurality of stirrup steel bars installed in a length direction of the H-steel at regular intervals to surround at least a part of the H-steel; and a plurality of tension/compression steel bars installed in parallel in a length direction of the H-steel.

More preferably, the stirrup steel bars include a lower steel bar unit extended across a lower portion of the lower flange of the H-steel; an intermediate steel bar unit extended upward from both ends of the lower steel bar unit; and an extension steel bar unit extended in both side directions from a front end of the intermediate steel bar unit.

In one embodiment, the extension steel bar unit may be located at a position relatively higher or lower than the upper flange of the H-steel.

In one embodiment, the stirrup steel bar may have a closed shape so that both ends of the stirrup steel bar are contacted to both sides of the web with surrounding the lower flange of the H-steel bar, whereby an upper portion of the stirrup steel bar is not buried in the concrete member but exposed out.

Also, the mold-concrete composite crossbeam according to the present invention may further include a plurality of extension members having a L-shaped section so that one ends of the extension members are fixed to both sides of the top of the stirrup steel bar and the other ends are extended outward in both side directions.

Preferably, the extension member has a front end located at a position relatively higher or lower than the upper flange of the H-steel.

In still another aspect of the present invention, there is also provided a method for constructing a building, comprising (a) installing a steel column at a position that will become a column of the building; (b) connecting both ends of a mold-concrete composite crossbeam to the steel column, the mold-concrete composite crossbeam including: a H-steel composed of an upper flange, a lower flange, and a web connecting the upper and lower flanges to each other; a concrete member formed in a length direction of the H-steel having a thickness such that the upper flange of the H-steel is exposed out but the lower flange and the web are at least partially buried therein; deck plate supports installed to both side edges of an upper surface of the concrete member so as to support a deck plate placed thereon; a reinforcing steel bar installed around the H-steel; a mold including a bottom detachably coupled to a lower end surface of the concrete member, and a pair of sidewalls formed in parallel to both sides of the bottom and detachably coupled to both end sides of the concrete member; a lateral reinforcing member coupled across both sidewalls of the mold to support the sidewalls; a side reinforcing member installed to an outer side of the sidewalls of the mold in a length direction thereof; and a plurality of bottom reinforcing members installed across a lower surface of the bottom of the mold across the lower surface; (c) placing a deck plate on the deck plate supports; (d) installing a steel bar on the deck plate; (e) putting concrete on the deck plate and the mold of the composite crossbeam to place and cure beam and slab; (f) dismantling the mold of the composite crossbeam.

Preferably, extension support units extended outward in both side directions are formed on upper edges of the sidewalls of the mold so as to support the deck plate, and the step (c) includes the step of inserting coupling bolts through coupling holes formed in the extension support units and through holes formed in the deck plate and then coupling the coupling bolts to buried nuts.

More preferably, the method for constructing a building according to the present invention further includes the steps of installing a prefabricated column mold composed of a plurality of sub mold bodies to surround the steel column; and coupling the mold to an opening of the sub mold body.

BRIEF DESCRIPTION OF THE DRAWINGS

These and other features, aspects, and advantages of preferred embodiments of the present invention will be more fully described in the following detailed description, taken accompanying drawings. In the drawings:

FIGS. 1 to 3 are sectional views showing conventional slab structures;

FIG. 4 is a side view showing a mold-concrete composite crossbeam according to a preferred embodiment of the present invention;

FIG. 5*a* is a partial perspective view showing the mold-concrete composite crossbeam except the mold;

FIG. 5*b* is a partial perspective view showing the mold-concrete composite crossbeam of FIG. 5*a*, seen from the below;

FIG. 6 is a schematic sectional view taken along the line A-A' of FIG. 4;

FIG. 7 is a schematic sectional view taken along the line B-B' of FIG. 4;

FIG. 8 is a schematic sectional view showing the line C-C' of FIG. 4;

FIG. 9 is a partial perspective view showing a mold-concrete composite crossbeam according to another embodiment of the present invention, except a mold;

FIG. 10 is a sectional view showing a mold-concrete composite crossbeam according to still another embodiment of the present invention;

FIG. 11 is a side view illustrating the process of constructing a crossbeam and slab structure using the mold-concrete composite crossbeam according to the preferred embodiment of the present invention;

FIG. 12 is a side view showing an example of connecting a mold-concrete composite crossbeam to a column according to another embodiment of the present invention;

FIG. 13 is a side view illustrating the process of constructing a crossbeam and slab structure using the mold-concrete composite crossbeam according to still another embodiment of the present invention;

FIG. 14 is a partial perspective view showing a mold for a prefabricated column according to still another embodiment of the present invention;

FIG. 15 is a side view illustrating the process of constructing a crossbeam and slab structure using the mold-concrete composite crossbeam in case the mold for a prefabricated column is employed according to still another embodiment of the present invention;

FIG. 16 is a sectional view illustrating the process of constructing a crossbeam and slab structure using the mold-concrete composite crossbeam according to a preferred embodiment of the present invention, which shows the region where a concrete member exists;

FIG. 17 is a sectional view illustrating the process of constructing a crossbeam and slab structure using the mold-concrete composite crossbeam according to a preferred embodiment of the present invention, which shows the region where the mold exists;

FIG. 18 is a sectional view illustrating the process of constructing a crossbeam and slab structure using the mold-concrete composite crossbeam according to another embodiment of the present invention, which shows the region where a concrete member exists;

FIG. 19 is a side view showing a mold-concrete composite crossbeam according to further another embodiment of the present invention;

FIG. 20 is a sectional view taken along the line D-D' of FIG. 19;

FIGS. 21 and 22 are a side view and a sectional view illustrating the process of constructing a crossbeam and slab structure using the mold-concrete composite crossbeam according to still another embodiment of the present invention;

FIGS. 23 and 24 are a side view and a sectional view illustrating the process of constructing a crossbeam and slab structure using the mold-concrete composite crossbeam according to still another embodiment of the present invention;

FIG. 25 is a partial perspective view showing a mold-concrete composite crossbeam according to another embodiment of the present invention, except a mold;

FIGS. 26 to 45 are sectional views showing a region of a concrete member of the mold-concrete composite crossbeam according to another embodiment of the present invention;

FIG. 46 is a side view showing a mold-concrete composite crossbeam according to another embodiment of the present invention;

FIG. 47 is a sectional view taken along the line E-E' of FIG. 46;

FIG. 48 is a sectional view taken along the line F-F' of FIG. 46;

FIG. 49 is a side view showing a mold-concrete composite crossbeam according to still another embodiment of the present invention;

FIG. 50 is a bottom view showing a connection portion of a mold part of the mold-concrete composite crossbeam of FIG. 49; and FIGS. 51 and 52 are a side view and a bottom view showing an example of the connection of a mold part according to another embodiment of the present invention.

BEST MODE FOR CARRYING OUT THE INVENTION

FIG. 4 is a side view showing a mold-concrete composite crossbeam according to a preferred embodiment of the present invention.

Referring to FIG. 4, the mold-concrete composite crossbeam of the present invention includes a H-steel 20, reinforcing steel bars installed around the H-steel 20 in its length direction, a concrete member 40, and molds 80 detachably installed to both ends of the concrete member 40.

FIGS. 5*a* and 5*b* schematically show only the concrete crossbeam of the mold-concrete of FIG. 4 except the mold, FIG. 6 is a sectional view taken along the line A-A' of FIG. 4, FIG. 7 is a sectional view taken along the line B-B' of FIG. 4, and FIG. 8 is a sectional view taken along the line C-C' of FIG. 4. Referring to FIGS. 5*a* to 8 together, the H-steel 20 is composed of an upper flange 21 and a lower flange 22 arranged in parallel, and a web 23 for interconnecting the upper and lower flanges 21, 22.

Preferably, a stud 22*a* buried in the concrete member 40 may be protruded on the lower flange 22 of the H-steel 20. This stud 22*a* plays a role of more firmly coupling the H-steel 20 and the concrete member 20.

More preferably, a plurality of through holes (not shown) are formed in the web 23 of the H-steel 20 so that the placed concrete may penetrated therein to enhance an adhesion force of the concrete member 40.

Selectively, a reinforcing plate 24 may be added to a region where the upper flange 21 and the web 23 of the H-steel 20 meet, so as to endure excessive loads during construction.

The reinforcing steel bar becomes a frame supporting the mold-concrete composite crossbeam, and it may have various arrays. In this embodiment, the reinforcing steel bar includes still up steel bars 30 installed at regular intervals in a length direction of the H-steel 20.

The stirrup steel bars 30 are installed to surround the H-steel 20 at regular intervals in a length direction of the H-steel 20. Preferably, the stirrup steel bars 30 include a lower steel bar unit 31 extended across the bottom of the lower flange 22 of the H-steel 20, intermediate steel bar units 32 extended upward from both ends of the lower steel bar unit 31, and extension steel bar units 33 extended in a side direction, more preferably outward in both side directions, from the top of the intermediate steel bar units 32.

The stirrup steel bars 30 play roles of regularly dispersing the compressing force, applied in a length direction of the H-steel 20, over the cross section of the H-steel 20, and also resisting the shear stress applied perpendicularly to the cross section.

The stirrup steel bars 30 may be installed so that they are partially buried in the concrete member 40 as shown in the drawings. In this case, the lower steel bar unit 31 is buried in the concrete member 40, and the intermediate steel bar units 32 are buried in the concrete member 40 so that their upper portions are partially exposed. In addition, the stirrup steel bar 30 may also be installed near both ends of the crossbeam where the concrete member 40 is not formed.

In addition, the reinforcing steel bar includes a plurality of tension/compression steel bars 60, 70 arranged in a length direction of the beam. The tension/compression steel bars 60, 70 become supports that resist tension and compression stresses applied to the mold-concrete composite crossbeam.

Preferably, the tension/compression steel bars include a plurality of buried tension/compression steel bars 60 (hereinafter, referred to as 'buried steel bars') at least partially buried in the concrete member 40, and exposed tension/compression steel bars 70 (hereinafter, referred to as 'exposed steel bars') not buried in the concrete member 40 but exposed outward.

The buried steel bars 60 are arranged in a length direction between the lower flange 22 of the H-steel 20 and the stirrup steel bar 30 surrounding the lower flange 22, and preferably installed in contact with the lower steel bar 31. In addition, in the region where the concrete member 40 is not formed, the stirrup steel bar 30 may be supported in a way of being welded or coupled to the buried steel bar 60.

In addition, so as to stably support the exposed portion of the buried steel bar 60 and/or the stirrup steel bar 30 not buried in the concrete member 40, as shown in FIG. 5*b*, a base bracket 34 for fixing the stirrup steel bar 30 to the H-steel 20 may be further provided. Specifically, the base bracket 34 is a plate extended from the bottom of the lower flange 22 of the H-steel 20 in a length direction, and the stirrup steel bar 30 is fixed to its upper surface by means of welding or the like. In addition, both ends of the base bracket 34 are attached to the lower surface of the lower flange 22 by means of welding or the like.

As another alternative, the exposed portion of the buried steel bar 60 may be directly fixed to the lower flange 22 of the H-steel 20 by means of the base bracket 35 that traverses the lower portion of the H-steel 20, as shown in FIG. 9. In FIG. 9, the stirrup steel bar is not shown for simplification.

According to the present invention, the exposed steel bar 70 is placed on the extension steel bar unit 33 of the stirrup steel bar 30, when being coupled. However, in this case, since the exposed steel bar 70 is spaced far from the center of the mold-concrete composite crossbeam in both side directions, the exposed steel bar 70 may pass aside a column when the mold-concrete composite crossbeam is connected to the column, as explained later.

Preferably, the exposed steel bar 70 may be configured so that it is positioned above or below the upper flange 21 of the H-steel 20. That is to say, the extension steel bar unit 33 may be positioned above or below the upper flange 21 of the H-steel 20, and accordingly the exposed steel bar 70 is also positioned above or below the upper flange 21.

In addition, an auxiliary cap bar 36 may be further provided to the mold-concrete composite crossbeam of the present invention as shown in FIG. 10 for the purpose of stable coupling of the exposed steel bar 70 placed on the extension steel bar unit 33.

The auxiliary cap bar 36 has a length corresponding to the distance between the exposed steel bars 70 positioned at both sides, and both ends of the auxiliary cap bar 36 are bent to surround the exposed steel bars 70. Thus, both ends of the auxiliary cap bar 36 are arranged to surround the exposed steel bars 70, and then they are combined thereto such as welding or coupling as mentioned above. In this case, it is advantageous that the exposed steel bars 70 are coupled in a more stable way.

The tension/compression steel bars 60, 70 may be fixed by means of welding or coupling means such as wire, and this coupling means is not limited to the embodiments of the present invention. In addition, the configuration of the reinforcing steel bars is not limited to the embodiments, and their configuration, number and positions may be changed in various ways.

The concrete member 40 is integrally formed along a length direction so that the H-steel 20 is at least partially buried therein. Preferably, the concrete member 40 is formed to expose the upper flange 21 of the H-steel 20 but bury at least a part of the lower flange 22 and the web 23.

As shown in the drawings, both ends of the H-steel 20 are kept exposed outward without being buried in the concrete member 40, which is directed to connecting the mold-concrete composite crossbeam to a column. For this purpose, a coupling hole 20*a* may be formed in the exposed end of the H-steel 20.

More preferably, the concrete member 40 is formed only on a part of the center of the H-steel 20. In this case, the entire weight of the composite crossbeam is greatly decreased to facilitate easier installation and construction. In the drawings, lengths of the concrete member and the mold are not limited, but suitably changed in design.

The concrete member 40 allows effective resistance against bending stress and compression force applied in an axial direction together with the H-steel 20. In addition, the concrete member 40 increases a sectional area of the mold-concrete composite crossbeam so that it may effectively cope with a bending stress.

According to the preferred embodiment of the present invention, though not shown in the drawings, the concrete member 40 may have different widths in a length direction. That is to say, the center region of the concrete member 40 may have a smaller width than both end regions to which a great load is directly applied. It is directed to decreasing the entire weight of the composite crossbeam due to the reduced concrete member 40, thereby facilitating easier carriage, handling and installation of the composite crossbeam.

In addition, the H-steel 20 is constructed so that it is buried in a slab concrete, explained later, together with the concrete member 40 and thus not exposed out, so there is no need of separate fire-resistant treatment. It becomes a factor of greatly improving fire resistance of a structure constructed using the mold-concrete composite crossbeam of the present invention.

Preferably, the concrete member 40 is formed to have a predetermined roughness on its upper surface. It is directed to enhancing a coupling force with a slab placed on its upper surface.

Though not shown in the figures, a thin steel wire or wire mesh is inserted into the concrete member 40 in a length direction so as to prevent cracks or damage of the concrete member.

Preferably, deck plate supports 50 are provided to both edges of the upper surface of the concrete member 40 so that a deck plate may be placed and supported thereon, as explained later. The deck plate support 50 includes a bracket 51 for supporting the deck plate, and a buried member 52 integrally formed with the bracket 51 and buried in the concrete member 40.

Preferably, the brackets 51 are made of metal material in a strip shape, installed in a length direction of the concrete member 40, and more preferably the brackets 51 are installed to protrude outward in both side directions from both edges of the upper surface of the concrete member 40.

The buried member 52 is buried in the concrete member 40 and plays a role of fixing the bracket 51.

According to the preferred embodiment of the present invention, a detachable mold 80 is provided to both ends of the concrete member 40. This mold facilitates easier placing of concrete, and also does not require a mold installation process to a connect portion when the concrete crossbeam is connected to a column.

The mold 80 includes a rectangular bottom 81 coupled to a lower surface of the end of the concrete member 40, and sidewalls 82, 83 formed in parallel on both sides of the bottom 81 and respectively coupled to both sides of the end of the concrete member 40, and its upper surface is opened so that concrete may be injected.

The mold 80 is formed using glass fiber, carbon fiber, Kevlar, or their mixture, or wound or extruded FRP fiber, and it may have several layers.

Additionally, a connection hole 81*a* (see FIG. 4) may be formed in an end of the bottom 81 of the mold. The connection hole 81*a* is used for fixing the mold-concrete composite crossbeam to a bracket installed to a column, as explained later.

Extension supports 84 are formed at edges of the tops of the sidewalls 82, 83 of the mold 80 so as to support the deck plate. The extension supports 84 are extended outward in both side directions from the tops of the sidewalls 82, 83, and preferably the extension supports 84 are integrally formed with the sidewalls. In addition, a coupling hole 84*a* is preferably further formed in each extension support 84 for coupling with the deck plate positioned thereon.

In addition, a plurality of drainage holes 80*a* (see FIG. 4) are preferably formed in the sidewalls 82, 83 so that water may be drained out when concrete is injected.

Though not shown in the drawings, corners where the bottom 81 and the sidewalls 82, 83 of the mold 80 meet are preferably tapered. In this case, as explained later, the mold may be dismantled more easily and the constructed concrete beam may have smooth edges.

As shown in FIG. 7, a hollow pipe may be installed between the through holes formed in the sidewalls 82, 83, and a transverse reinforcing member may be inserted therein with both ends being fixed by bolts, so that the transverse reinforcing member may be removed after concrete is placed and cured.

According to the present invention, side reinforcing members 92 are installed to the outer surfaces of the sidewalls 82, 83 in a length direction. The side reinforcing members 92 are preferably angled steel pipes, through which the transverse reinforcing members 90 are passed and fixed by nuts 91 so as to firmly support the sidewalls 82, 83. The transverse reinforcing members 90 and the side reinforcing members 92 prevent the sidewalls 82, 83 of the mold from being opened outward or deformed due to the load of concrete when the concrete is placed thereon, as explained later.

In addition, the lower surface of the bottom 81 of the mold 80 is supported by a plurality of bottom reinforcing members 93. The bottom reinforcing members 93 are installed to support the mold across the lower surface of the bottom 81, and they are kept suspended on the side reinforcing members 92.

That is to say, a hanging rod 94 vertically passing through the side reinforcing member 92 is positioned through the bottom reinforcing member 93, and both ends of the hanging rod 94 are coupled to nuts 95, 96 respectively so that the bottom reinforcing member 93 is suspended to the side reinforcing member 92.

This bottom reinforcing member 93 prevents the bottom 81 of the jacket itself from being bent downward or deformed when concrete is placed thereon.

The side reinforcing member 92 and the bottom reinforcing member 93 may be installed in advance before the mold-concrete composite crossbeam is constructed to a column, or they may be installed after the crossbeam is connected to a column as an alternative.

Preferably, the exposed portion of the stirrup steel bar 30 and the buried steel bar 60 may be supported by the bottom reinforcing member 93. At this time, as shown in FIG. 7, a coupling bolt 97 is installed through the bottom reinforcing member 93, and then a buried nut 8 is coupled to an end of the coupling bolt 97. The buried nut 98 is welded to a lower surface of the base bracket 34 so that the stirrup steel bar 30 and the buried steel bar 60 may be supported more stably. In this case, concrete may be placed without hanging the upper portion of the mold and supporting the lower portion of the mold.

The buried nut 98 is formed to surround the entire screwed portion of the coupling bolt 97 so that the coupling bolt is not contracted with concrete. Thus, when the mold is dismantled, the coupling bolt 97 may be easily released, but the nut 98 is still buried in the concrete member.

FIG. 8 is a sectional view showing a connection portion of the mold 80 and the concrete member 40. Referring to FIG. 8, a plurality of coupling holes are formed in the bottom 81 and the sidewalls 82, 83 of the mold 80, positioned in the connection portion, and a coupling bolt 85 is inserted therein and combined with a buried nut 86 buried in the concrete member 40.

The buried nut 86 has the same configuration and function as above. Thus, the mold 80 is positioned so that the bottom 81 and the sidewalls 82, 83 of the mold 80 are contacted with the lower and side surfaces of the concrete member 40 respectively, and then they are mutually fixed using the coupling bolt 85 and the buried nut 86. At this time, auxiliary iron pieces 87, 88 may be further provided for more firm and stable coupling.

Now, a method for constructing a building using the mold-concrete composite crossbeam configured as above will be explained.

The mold-concrete composite crossbeam of the present invention may be simply installed to a steel column, as shown in FIG. 11 as an example.

As shown in FIG. 11, first, the mold-concrete composite crossbeam of the present invention is coupled to a steel column 200. Then, a coupling plate 210 is installed to the steel column 200, and a coupling member such as a bolt 220 is coupled through a coupling hole 20*a* formed in an end of the H-steel 20 so that the composite crossbeam is fixed to the steel column. As another alternative, the end of the H-steel 20 may be coupled to the steel column 200 by means of welding.

At this time, the exposed steel bar 70 of the mold-concrete composite crossbeam is placed on the extended steel bar unit 33 of the stirrup steel bar 30 and thus relatively inclined outward in both side directions from the center of the composite crossbeam, so the exposed steel bar 70 is not interfered with the steel column 200 but passes aslant from the column as shown in FIG. 11.

The mold may be supported in various ways. For example, as shown in FIG. 11, the end of the mold 80 may be supported by an additional mold 230 installed to a region where a column is to be installed. That is to say, after the additional mold 230 for placing a column is installed, a support 231 made of such as wood is attached to the top of the additional mold 230, and then the mold is placed on the support 231. In this case, a coupling member such as a nail 232 is driven through a connection hole (not shown) formed at the end of the bottom 81 of the mold 80 so as to fix the mold 80 to the support 231.

In addition, the H-steel 20 of the mold-concrete composite crossbeam may be connected to the steel column 200 as shown in FIG. 12. That is to say, as shown in FIG. 12, a coupling bracket 200*a* is installed to the steel column 200, and then the end of the H-steel 20 is connected thereto using a coupling member such as a plurality of bolts 220' and at least one coupling plate 210'.

Preferably, the coupling bracket 200*a* has the same sectional shape as the H-steel 20. As another alternative, the end of the H-steel 20 may be coupled to the end of the coupling bracket 200*a* by means of welding.

Besides, as in FIG. 13 that shows another embodiment of the present invention, a mold support bracket 240 is installed to one side of the steel column 200, and then the mold 80 is fixed thereto. At this time, a coupling bolt 101 may be inserted into a connection hole (not shown) formed near the end of the bottom 81 of the mold so as to couple the mold with the bracket 240, thereby stably fixing the mold.

The coupling bolt 101 is coupled to a buried nut 102 after passing through the connection hole formed in the bottom 81 of the mold 80 and a through hole formed in the bracket 240. At this time, as explained later, when it is intended to dismantle the mold 80 after curing concrete, the bottom 81 of the mold is coupled to the lower surface of the bracket 240. Reference numeral 103 designates a reinforcing washer.

FIGS. 14 and 15 illustrate a method for coupling a mold according to another embodiment of the present invention.

FIG. 14 shows a prefabricated column mold used for constructing a column. The prefabricated column mold 300 includes a plurality of sub-mold bodies 310, 320 assembled with each other to surround the steel column 200. The sub-mold bodies 310, 320 may have suitable size and length in correspondence to the length of a column to be constructed. In this embodiment, it is illustrated that two sub-mold bodies 310, 320 are assembled by a coupling means 330 to face each other, but the prefabricated column mold may be composed of plural, for example 4, sub-mold bodies, not limited to the above.

At least one opening 340 is formed in the sub-mold bodies 310, 320 so that a mold-concrete composite crossbeam may be received therein. The opening 340 has a size capable of being coupled with the mold 80, and a plurality of coupling brackets 341*a*, 341*b*, 341*c* used for coupling with the mold 80 are formed at edges of the sub-mold bodies 310, 320 having the opening 340. In addition, a plurality of through holes 342 are formed in the coupling brackets 341*a*, 341*b*, 341*c* for coupling of a coupling bolt or the like.

More preferably, a deck plate support bracket 343 is formed at the top of the sub-mold bodies 310, 320 so that a deck plate may be placed thereon, as explained later.

Referring to FIG. 15, the sub-mold bodies 310, 320 are assembled to surround the steel column 200 at a position where a column is to be formed. And then, the H-steel 20 of the mold-concrete composite crossbeam is connected to the steel column 200 as described above.

At this time, the end of the mold 80 is coupled to the coupling brackets 341*a*, 341*b*, 341*c*. Specifically, the bottom 81 of the mold 80 is coupled to the coupling bracket 341*a*, and the sidewalls 82, 83 are coupled to the coupling brackets 341*c*, 341*b*, respectively.

To couple the mold 80 with the coupling brackets 341*a*, 341*b*, 341*c*, as shown in FIG. 15, a coupling bolt 344 is inserted through the connection hole formed in the end of the mold 80 and the through holes 342 formed in the coupling brackets 341*a*, 341*b*, 341*c*, and then screwed with a buried nut 345. At this time, in order to dismantle the mold 80 after curing the beam and slab, the mold 80 is preferably coupled to the outer sides of the coupling brackets 341*a*, 341*b*, 341*c*, but not limitedly.

In addition, according to the construction method of the present invention, the lower portion of the mold may be supported in various structures. In this case, there is no need of bolt and nut coupling in the lower portion for fixing the mold. Specifically, as shown in FIG. 11, a pair of first alignment stoppers 250 are installed across the lower surface of the bottom 81 of the mold 80 at regular interval. These alignment stoppers 250 preferably employ strip rods made of carbon-glass fiber or metal with a L-shaped section.

A support bar 251 made of metal is installed between the first alignment stoppers 250 across the mold body. Preferably, a support bracket 252 is further provided to the support bar 251 so as to increase a contact area with the lower surface of the bottom 81 of the mold for the purpose of stable support. Both ends of the support bracket 252 are contacted with the first alignment stoppers 250, so the movement of the support bracket 252 is restricted.

A first support column 260 is installed to a lower portion of the support bar 251 to support the support bar 251. A concave bracket 261 corresponding to the shape of the support bar 251 is provided to the end of the first support column 260 so as to stably receive and support the support bar 251.

FIG. 11 also shows another example of the support column.

Specifically, a pair of second alignment stoppers 270 are installed across the lower surface of the bottom 81 of the mold 80 at regular interval. The second alignment stopper 270 also preferably employ strip rods made of carbon-glass fiber or metal with a L-shaped section.

A support bar 271 made of metal is installed across the mold 80 between the second alignment stoppers 270. Preferably, a support bracket 272 is further formed on the support bar 271 so as to increase the contact area with the lower surface of the bottom 81 of the mold for the purpose of stable support. Both ends of the support bracket 272 are contacted with the second alignment stoppers 270, so the movement of the support bracket 272 is restricted.

A second support column 280 is installed to a lower portion of the support bar 271 to support the support bar 271. A support block 281 is provided to the end of the second support column 280. The support block 281 has a width corresponding to a distance between the second alignment stoppers 270, and thus the support block 281 is coupled between the second alignment stoppers 270 to restrict its movement.

As explained later, after concrete is cure, the composite mold may be dissembled with dismantling the support columns.

If the mold-concrete composite crossbeam installed as mentioned above is completely coupled with the steel column 200, a deck plate 400 is installed thereon, as shown in FIGS. 16 and 17. Here, FIG. 16 is a sectional view showing a region where the concrete member 40 exists, and FIG. 17 is a sectional view showing a region where the mold 80 exists.

The deck plate 400 is generally made of steel material, and commonly it is manufactured and supplied integrally with a crank steel bar 103. The deck plate 400 is placed on brackets 51 provided to both edges of the upper surface of the concrete member 40, and on an extension support 84 of the mold 80.

Preferably, the deck plate 400 is welded to the bracket 51, or a coupling bolt 111 is subsequently passed through the coupling hole 84*a* (see FIG. 8) formed in the extension support 84 and the through hole formed in the deck plate 400 and then coupled to a buried nut 112.

At this time, it is preferred that a reinforcing plate 53 (see FIG. 16), 54 (see FIG. 17) is provided to the bracket 51 and/or the extension support 84 so as to further reinforce the supporting force.

An additional steel bar is provided to the slab, and the additional steel bar preferably includes reinforcing steel bars 110 respectively installed to both sides of the H-steel 20, and a connection steel bar 120 installed across the H-steel 20. The connection steel bar 120 may be installed through a hole (not shown) formed in a web 23 of the H-steel 20. Preferably, the connection steel bar 120 may be combined using wire or the like in contact with the exposed steel bar 70 and/or the intermediate steel bar unit 32 and/or the extension steel bar unit 33 of the stirrup steel bar 30.

More preferably, the connection steel bar 120 is installed adjacent to the reinforcing steel bar 110 to play a role of transferring a compression force applied to the reinforcing steel bar 110 at one side to the reinforcing steel bar 110 at the other side. It is already known that stress may be mutually transferred among steel bars if the steel bars buried in concrete are adjacent to each other within a predetermined interval.

The deck plate 400 may be fixed by means of coupling between the crank steel bar 103 and the connection steel bar 120 and/or the exposed steel bar 70. That is to say, the crank steel bar 103 is combined by wire or the like and fixed at the contact portion with the connection steel bar 120 and/or the exposed steel bar 70. Preferably, the crank steel bar 103 may also be combined with the extension steel bar unit 33 of the stirrup steel bar 30.

As another example of the present invention, FIG. 18 shows the coupling state of the crank steel bar 103 when the extension steel bar 33 of the stirrup steel bar 30 is positioned lower than the upper flange 21 of the H-steel 20. In this case, the crank steel bar 103 is coupled to the exposed steel bar 70 and/or the extension steel bar unit 33 of the stirrup steel bar 30 together with the connection steel bar 120.

If the mold-concrete composite crossbeam is completely installed as mentioned above, additional reinforcing steel bar and mold are installed as required. Preferably, a metal lath may be installed above the deck plate only on a partial region of the slab.

After that, concrete is placed and cured in the mold and slab region. As concrete is placed, the buried nut and the lateral reinforcing member 90 are buried in the concrete. The lateral reinforcing member 90 prevents the mold from being crushed or deformed in a lateral direction due to the weight of concrete.

If the concrete for a beam is completely placed using the mold-concrete composite crossbeam as mentioned above, the cross may sufficiently endure the soil pressure, so there is no need to separately install a conventional construction such as strut.

According to the present invention, after the concrete is cured, the mold may be removed and then recycled. That is to say, the nut 91 and the coupling bolt 97 (see FIG. 7), 85 (see FIG. 8), 101 (see FIG. 13), 111 (see FIG. 17) at both ends of the lateral reinforcing member may be released to dismantle the mold. These coupling bolts are not contacted with concrete, so they may be easily released. In addition, the buried nuts are kept their buried state in concrete.

After the nuts and coupling bolts are released, the composite mold may be easily separated. Preferably, an existing separator is coated on the inner side of the composite mold in advance before concrete is placed thereon, so that the composite mold may be separated more easily. Selectively, a plurality of release rings (not shown) may be installed in advance to the bottom 81 and the sidewalls 82, 83 of the mold 80 so that the mold may be easily dismantled by hooking hooks or the like in the release rings and then pulling the hooks after concrete is cured.

After concrete is cured, the deck plate 400 may be used as a permanent structure without being dismantled.

FIGS. 19 and 20 show a mold-concrete composite crossbeam according to still another embodiment of the present invention. Here, the same reference numeral as in the former drawings designates the same component.

In the mold-concrete composite crossbeam of this embodiment, a plurality buried tubes 100 are installed to the bottom 81 of the mold 80. The buried tubes 100 have hollow therein, and their lower ends are fixed through the bottom 81 of the mold 80 and their upper ends are extended upward. Preferably, the buried tubes 100 have a length so that their upper ends may be exposed over the surface of slab to be placed.

The buried tubes 100 are preferably installed in symmetry with the mold 80. It allows the buried tubes 100 to support the mold in balance, as explained later.

Preferably, the buried tubes 100 are installed to come in contact with the lateral reinforcing member 90, and they are coupled with each other so that the buried tubes 100 may be supported more stably.

Preferably, a through hole 93*a* communicated with the hollows of the buried tubes 100 is formed in the bottom reinforcing member 93 that is installed on the bottom of a region where the buried tubes 100 are formed, so that a hanging steel bar or wire may pass through it.

FIGS. 21 and 22 illustrate the process of constructing beams and slab using the mold-concrete composite crossbeam of this embodiment. Here, reinforcing steel bars are not shown in the drawings for simplification.

First, before a composite crossbeam is connected to the steel column 200, a support shape steel 130 is installed thereon. A support member 140 is installed on the support shape steel 130 to cross the support shape steel 130, and the composite crossbeam is suspended thereto.

Specifically, the H-steel 20 of the mold-concrete composite crossbeam of this embodiment is coupled to the steel column 200 as explained above. At the same time, the mold 80 is suspended to the support member 140 using a hanging wire or steel bar 150.

That is to say, the hanging steel bar 150 is inserted into the through holes formed at both ends of the support member 140, and then passed through the buried tube 100 of the mold 80 positioned in its lower layer, then both ends of the hanging steel bar 150 are fixed using upper and lower nuts 151, 152. Preferably, both ends of the hanging steel bar 150 are screwed so that the upper and lower nuts 151, 152 may be easily coupled and fixed thereto.

In addition, in order to support the mold 80 stably, a bottom reinforcing member 93 is further provided to the bottom 81 of the mold, and the hanging steel bar 150 is coupled through the bottom reinforcing member 93 to the lower nut 152.

As mentioned above, since the composite mold is suspended in the air, there is no need of additionally installing a support such as a puncheon below the composite mold, and thus it is possible to ensure sufficient working space below the composite mold.

After that, the process of placing and curing concrete to construct beams and slab is identical to that of the former embodiment. However, when concrete is put into the mold 80, the end of the buried tube 100 should be exposed over the upper surface of the concrete.

In case of dismantling the mold 80 after concrete is cured, the upper and lower nuts 151, 152 are released to remove the hanging steel bar 150. In this case, the buried tube 100 keeps buried in the slab concrete.

If the beams and slab are completely constructed using the mold-concrete composite crossbeam of this embodiment, beams and slab in its lower layer may be easily constructed. It is well shown in FIGS. 23 and 24. In the drawings, reinforcing steel bars are not shown for simplification.

As shown in FIGS. 23 and 24, if slab and beams of the upper layer are completely constructed using the mold-concrete composite crossbeam, another mold-concrete composite crossbeam is installed to its lower layer. At this time, additional excavation can be conducted for ground construction as required.

The mold-concrete composite crossbeam of a lower layer is connected to the steel column 200 in the same way as above. At this time, the mold 80 of the lower layer is suspended to the upper composite crossbeam structure suing a hanging wire or steel bar 150.

That is to say, the hanging steel bar 150 is inserted into the first buried tube 100 positioned in the concrete of the already completed upper composite crossbeam structure, and the buried tube 100' and the bottom reinforcing member 93 of a composite crossbeam positioned in its lower layer are passed through the first buried tube 100, and then both ends of the buried tube 100' are fixed using the upper and lower nuts 151, 152.

After that, concrete is placed and cured for the slab of the lower layer and the mold is dismantled in the same manner as explained above.

This construction method may be applied to all kinds of structures above or below the ground. For example, in case of constructing an underground structure, the beam and slab construction process is continuously conducted to the bottom of the underground structure. In addition, if concrete is placed and cured till the bottom of the underground structure, slab and underground walls may be constructed from the bottom.

As another alternative, it is possible that beam structure is constructed sparsely in some underground stories, not in all underground stories, and slab and beams are constructed to the other stories after concrete is completely placed for the bottom of the lowest story. At this time, so-called 'up-up construction' may be applied in which, while slab and underground walls are constructed from the bottom story, the structure over the ground may be constructed at the same time.

As still another alternative, so-called 'top-down construction' may also be applied in which, after beams or a part of slab are completely constructed for the bottom of the structure over the ground, the structure over the ground is constructed together with excavation and construction of the underground structure. Here, beams and slab for the structure over the structure are constructed together with excavation and construction of the underground structure.

This construction is available since the beams constructed using the composite crossbeam of the present invention may sufficiently endure the soil pressure.

Though it has been illustrated that the mold-concrete composite crossbeam already combined with the buried tube and the lateral reinforcing member is installed to a shape steel and then used for construction, it is also possible that the mold is firstly installed and then the buried tube and the lateral reinforcing member are installed, not limited to the above.

According to the present invention, a connection H-steel 20' for connecting another steel crossbeam to the middle of the mold-concrete composite crossbeam may be further provided as shown in FIG. 25. That is to say, the connection H-steel 20' is adhered to the H-steel 20 of the composite crossbeam by means of welding or the like to be protruded vertically. A coupling hole **20*a*' may be formed at the end of the connection H-steel 20'** for coupling with another mold-concrete composite crossbeam or H-steel.

FIGS. 26 to 45 shows a mold-concrete composite crossbeam according to further other embodiments of the present invention. Here, the same reference numeral as in the former drawings designates the same component.

As shown in FIGS. 26 to 45, various kinds of reinforcing steel bars may be installed to the mold and the concrete member. Hereinafter, each embodiment will be explained with reference to only the sectional view showing the region where the concrete exists.

In the mold-concrete composite crossbeam shown in FIG. 26 according to another embodiment of the present invention, the extension steel bar unit 33 of the stirrup steel bar 30 is not integrally formed with but separately from the intermediate steel bar unit 32, so the extension steel bar unit 33 is adhered there to by means of welding or the like when the composite crossbeam is made at the construction spot. In case the extension steel bar unit 33 is prepared separately, the composite crossbeam may be carried or handled more easily.

An extension steel bar unit **33*a* of a stirrup steel bar 30*a* provided to the mold-concrete composite crossbeam shown in FIG. 27 has its front end bent to surround a part of the outer circumference of the exposed steel bar 70**.

In this case, when the exposed steel bar 70 is welded or combined to the extension steel bar unit **33*a*, it is possible to ensure more stable coupling force. Furthermore, it is also allowed that the aforementioned auxiliary cap bar 36 (see FIG. 10**) is not provided.

Referring to FIG. 28, the mold-concrete composite crossbeam according to another embodiment of the present invention is provided with a connection steel bar 410 extended from the web 23 of the H-steel 20 in both side directions.

The connection steel bar 410 is used for reinforcing the connection with the slab installed on the mold-concrete composite crossbeam. Preferably, the connection steel bar 410 includes an extension **410*a* extended in both side directions in parallel with the slab from the web 23 of the H-steel 20, and a fixing unit 410*b* extended downward in parallel with the web 23 and buried in the concrete member 40. More preferably, the fixing unit 410*b* may be fixed to the web 23** by means of welding or the like.

The connection steel bar 410 may be installed between the stirrup steel bars 30 or in contact with the stirrup steel bars 30. In case of being contacted with the stirrup steel bar 30, the connection steel bar 410 may be coupled thereto by welding or the like.

In addition, if slab is installed after installing the deck plate 400 (see FIG. 16) to the connection steel bar 410, the connection steel bar 410 is buried in the slab to keep coupling with the slab more firmly.

According to another embodiment of the present invention, the connection steel bar may be modified in various ways in order to enhance a coupling force with the concrete member 40. That is to say, as shown in FIG. 29, the connection steel bar 410' includes an extension **410*a*' extended in both side directions from the web 23 of the H-steel 20, and a fixing unit 410*b*' downwardly extended at a predetermined angle with the web 23 so that its end is buried in the concrete member 40 with being coupled to the lower flange 22 of the H-steel 20** by welding or the like.

In this case, the fixing unit **410*b*' of the connection steel bar 410' may further enhance a coupling force with the concrete member 40**.

Another embodiment to enhance a coupling force with the concrete is shown in FIG. 30. Referring to FIG. 3, the mold-concrete composite crossbeam of this embodiment includes a support 50' provided to the concrete member 40, and the support 50' includes a bracket 51' for supporting the deck plate 400 (see FIG. 16), and a buried member 52' integrally formed with the bracket 51' and extended to the lower flange 22 of the H-steel 20 so as to be buried in the concrete member 40.

Here, an end of the buried member 52' is fixed to the lower flange 22 by means or welding or the like so that the buried member 52' acts as a reinforcing member to enhance a coupling member 40 with the concrete member 40.

FIG. 31 showing another embodiment of the present invention illustrates a mold-concrete composite crossbeam that may effectively resist an axial stress together with enhancing a coupling force with the concrete member.

According to this embodiment, a pair of first and second auxiliary steel bars 121, 122 are further installed in the concrete member 40 in a length direction. The first auxiliary steel bar 121 is installed to be inscribed to the intermediate steel bar unit 32 of the stirrup steel bar 30, and the second auxiliary steel bar 122 is installed to be inscribed to the web 23 of the H-steel 20. These auxiliary steel bars also play a role of effectively resisting an axial stress.

In addition, the auxiliary steel bars 121, 122 are interconnected using a coupling steel bar 420. The coupling steel bar 420 is buried in the concrete member 40 with both ends being coupled or welded to the auxiliary steel bars 121, 122, respectively.

The coupling steel bars 420 may be positioned between the stirrup steel bars 30 at regular intervals, but preferably fixed in contact with the stirrup steel bars 30. In this case, the coupling steel bars 420 configure a closed steel bar shape together with the stirrup steel bars 30, thereby playing a role of more effectively resisting a stress applied in an axial direction.

FIG. 32 shows an example that the auxiliary steel bars 121, 122 and the coupling steel bars 420 are provided to the mold-concrete composite crossbeam of FIG. 30. In this case, the first auxiliary steel bar 121 is installed to be inscribed to the intermediate steel bar unit 32 of the stirrup steel bar 30, and the second auxiliary steel bar 122 is installed to be inscribed to the fixing unit 110*b* of the connection steel bar 110.

The mold-concrete composite crossbeam shown in FIG. 33 according to another embodiment of the present invention is provided with a closed stirrup steel bar 180. The closed stirrup steel bar 180 surrounds the lower flange 22 of the H-steel 20 and also its both ends come in contact with both sides of the web 23. Both ends of the closed stirrup steel bar 180 are supported or welded without any separate fixture.

In addition, the upper portion of the closed stirrup steel bar 180 is not buried in the concrete member 40 but exposed out, so it is buried in the slab during construction to enhance a mutual coupling force with concrete. In this case, there is no need of providing a separate connection steel bar mentioned above.

In this embodiment, at a portion that requires installation of the exposed steel bar 70, an extension member 160 where the exposed steel bar 70 is welded or coupled may be installed as shown in the figure.

The extension member 160 plays the same function as the extension steel bar unit 33' of the embodiment shown in FIG. 26, and it substantially has a L shape. One end of the extension member 160 is fixed to both edges of the upper portion of the closed stirrup steel bar 180 by means of welding, and the other end is extended outward in both side directions so that the exposed steel bar 70 may be fixed thereto.

The extension member 160 may be installed entire in a length direction or selectively installed as required in a region where the exposed steel bar 70 is installed.

Referring to FIG. 34 showing still another embodiment of the present invention, a support on which a deck plate is positioned and supported is provided on the concrete member 40. The support includes bracket 51s provided to edges of the upper surface of the concrete member 40 to support the deck plate, and a connection rod 54 buried in the concrete member 40 to interconnect and support the brackets 51.

The connection rod 54 passes through the through hole formed in the web 23 of the H-steel 20 so that its one end is fixed to the bracket 51 at the left and the other end is fixed to the bracket 51 at the right.

More preferably, the connection rod 54 may be installed in contact with or adjacent to the Stirrup steel bar 30. In this case, the stirrup steel bar 30 and the connection rod 54 may further enhance a coupling force with concrete and increase a constraining force of the concrete.

According to further another embodiment of the present invention, as shown in FIG. 35, the mold-concrete composite crossbeam may include a rectangular cover member 170 that surrounds and protects the concrete member 40.

The cover member 170 is made of synthetic resin including carbon fiber FRP or glass fiber FRP, and the cover member 170 is installed to surround side and lower sides of the concrete member 40.

Preferably, the cover member 170 may play a role of mold for the region where the concrete member is formed, when the mold-concrete composite crossbeam of the present invention is manufactured. For example, if reinforcing steel bars such as the H-steel 20 are installed to the cover member 170 and then concrete is placed and cured, a mold-concrete composite crossbeam integrally coated with the cover member 170 may be obtained.

In this case, the cover member 170 may prevent the mold-concrete composite crossbeam from being scratched or damaged during carriage or construction.

According to another embodiment of the present invention, as shown in FIG. 36, a bent corner member 170' may be installed to an edge of the lower end of the concrete member 40 of the mold-concrete composite crossbeam in a length direction.

In this case, the corner member 170' may be made of steel material or synthetic resin including carbon fiber FRP or glass fiber FRP. More preferably, at least one stud may be provided to the corner member 170' in order to enhance a coupling force between the corner member 170' and the concrete member 40.

The mold-concrete composite crossbeam shown in FIGS. 26 to 36 have a concrete member with a rectangular section, but it should be understood that the same concept may be applied to a mold-concrete composite crossbeam having a concrete member with a trapezoidal section, though not shown in the figures.

Referring to FIG. 37 showing another embodiment of the present invention, the concrete member 40' has a trapezoidal section whose upper surface is wider than the lower surface. In this case, since the upper surface of the concrete member 40' is wider than the lower surface, the area where the deck plate 400 (see FIG. 16) is placed is increased.

Now, refer to FIG. 38 showing another embodiment of the present invention. The mold-concrete composite crossbeam of this embodiment includes a H-steel 20, stirrup steel bars 30' installed at regular intervals to surround the lower portion of the H-steel 20, and a concrete member 40' placed to bury at least a part of the H-steel 20 and having a trapezoidal section.

According to this embodiment, the stirrup steel bar 30' includes a lower steel bar unit 31' extended below the lower flange 22 of the H-steel across the lower flange 22 with being buried in the concrete member 40', an intermediate steel bar unit 32' extended with a slant upward and outward from both ends of the lower steel bar unit 31' and having an upper end exposed out of the concrete member, and an extension steel bar unit 33' extended outward in both side directions at the upper end of the intermediate steel bar unit 32'.

The intermediate steel bar unit 32' of this embodiment is preferably extended with a slant in parallel with the side of the trapezoidal concrete member 40'. Thus, even when the exposed steel bar 70 is installed out of the extension steel bar unit 33' as well as installed adjacent to the corner, the exposed steel bar 70' does not interfere with a column when a shape steel is connected to the column, as explained later.

Preferably, a support 50" where a deck plate is placed and supported may be further provided to an edge of the upper surface of the concrete member 40' of this embodiment. The support 50" includes a bracket 51" for supporting the deck plate, and a buried member 52" integrally formed with the bracket 51" and buried in the concrete member 40.

More preferably, the bracket 51" is a strip member made of metal material with a sectional shape corresponding to the edge of the upper surface of the concrete member 40', for example a L-shaped section. More preferably, the bracket 51" is not protruded out for better appearance, but installed so that the section of the bracket 51" corresponds to the section of the edge of the upper surface of the concrete member 40'. Preferably, the outer surface of the bracket 51" configures the same plane as the edge surface of the concrete member 40'.

Referring to FIG. 39 showing another embodiment of the present invention, the mold-concrete composite crossbeam of this embodiment includes a H-steel 20, stirrup steel bars 30" installed at regular intervals to surround a lower portion of the H-steel 20, and a concrete member 40' placed to bury at least a part of the H-steel 20 and having a trapezoidal section.

According to this embodiment, the stirrup steel bar 30" includes a lower steel bar unit 31" extended below the lower flange 22 of the H-steel 20 across the lower flange 22 with being buried in the concrete member 40' an intermediate steel bar unit 32" extended with a slope upward and outward from both ends of the lower steel bar unit 31" and having an upper end exposed out of the concrete member, and an extension steel bar unit 33" extended inward from the upper end of the intermediate steel bar unit 32".

The intermediate steel bar unit 32" of this embodiment is extended in parallel with the side of the trapezoidal concrete member 40'. Thus, though the exposed steel bar 70" is installed adjacent to the corner of the extension steel bar unit 33", the exposed steel bar 70" dose not interfere with a column when a shape steel is connected to the column. Accordingly, there is no need of extending the extension steel bar unit 33" outward in a side direction.

FIGS. 40 and 41 shows a mold-concrete composite crossbeam according to another embodiment of the present invention. In this embodiment, a hollow 40*b*, 40'*b* preferably having a rectangular section is formed at the center of the concrete member 40*a*, 40'*a* in a length direction. This hollow 40*b*, 40'*b* may be formed by installing a metal lath 142 to a region where the hollow of the concrete 40*a*, 40'*a* will be formed, and then placing concrete thereto. The hollow 40*b*, 40'*b* gives an effect of decreasing the entire weight of the mold-concrete composite crossbeam since concrete is at least partially not filled in the concrete member 40*a*, 40'*a*. Thus, it becomes easier to carry or construct the mold-concrete composite crossbeam of this embodiment.

The size of the hollow 40*b*, 40'*b* may be suitably adjusted depending on size and weight of the mold-concrete composite crossbeam, and preferably set so that at least a part of the lower flange 22 of the h-steel 20 is buried in the concrete member 40*a*, 40'*a*. As an alternative, the lower flange 22 may be entirely buried in the concrete member 40*a*, 40'*a*. This hollow 40*b*, 40'*b* is formed at least partially, preferably entirely, in a length direction of the concrete member 40*a*, 40'*a*.

Preferably, at least one stud steel bar 135, 136 may be further installed to the concrete member 40*a*, 40'*a* at a region where the hollow 40*b*, 40'*b* exists. The stud steel bar 135, 136 enhances a coupling force with concrete when concrete is put into the hollow 40*b*, 40'*b* for placing slab therein. More preferably, one end of the stud steel bar 135, 136 is fixed to the stirrup steel bar 180, 30', and the other end is extended to the hollow 40*b*, 40'*b*.

As another alternative, as shown in FIG. 42, it is possible to form a shear key 51 in a concrete side in the hollow instead of the stud steel bar, so as to enhance a coupling force with concrete.

In addition, in order to reduce the weight of the mold-concrete composite crossbeam to the minimum, as shown in FIGS. 43 and 44, a hollow 40*d*, 40'*d* whose width is gradually increased upward may be formed at the center of the concrete member 40*c*, 40'*c*.

That is to say, the hollow 40*d*, 40'*d* has a small width at a portion where both ends of the lower flange 22 of the H-steel 20 are buried, but the hollow 40*d*, 40'*d* has an increasing width upward so that the weight of the concrete member 40*c*, 40'*c* may be reduced to the minimum. Preferably, the hollow 40*d*, 40'*d* is formed to have a trapezoidal sectional shape. When concrete is placed, the concrete is filled in the hollow so that slab and beams are integrally constructed.

Referring to FIG. 45 showing another example of the present invention, a filler member 190 may be provided in the hollow 40*d* (see FIG. 43) of the concrete member 40*c*. The filler member 190 plays a roll of filling the hollow, which allows easier construction since there is no need of penetrating concrete into the hollow when the concrete is placed for construction of slab. The filler member 190 preferably employs Stryofoam, but not limitedly.

FIGS. 46 to 48 show a mold-concrete composite crossbeam according to another embodiment of the present invention. Here, the same reference numeral as in the former drawings designates the same component.

Referring to FIGS. 46 to 48, in the mold-concrete composite crossbeam of this embodiment, the concrete member includes a main concrete member 440 formed with a thickness $T_2$ (see FIG. 48) that exposes the upper flange 21 of the H-steel 20 but bury at least a part of the web 23 and the lower flange 22, and a sub concrete member 441 extended from a lower portion of the end of the main concrete member 440 and formed with a thickness $T_1$ (see FIG. 47) relatively smaller than the main concrete member 440.

The main concrete member 440 is formed at the center of the mold-concrete composite crossbeam, while the sub concrete member 441 is formed at both ends. The sub concrete member 441 may be formed so that its upper surface comes in contact with the lower surface of the lower flange 22 of the H-steel 20, or so that the lower flange 22 is buried therein.

The sub concrete member 441 is formed at a portion where the mold will be installed, so the sub concrete member 441 itself acts as a bottom mold.

According to this embodiment, a mold 380 composed of a pair of sidewalls 382, 383 is detachably installed to both sides of the sub concrete member 441. That is to say, the sidewalls 382, 383 of the mold 380 are contacted with an end side of the main concrete member 440 and the side of the sub concrete member 441 respectively, and the sub concrete member 441 and the sidewalls 382, 383 form a space where concrete will be placed. At this time, a coupling bolt 385 passes through the through holes formed in the sidewalls 382, 383 and coupled to a buried nut 386 buried in the sub concrete member 441, thereby fixing the mold.

In addition, referring to FIG. 48 showing a connection unit of the main concrete member 440 and the mold 380, a plurality of coupling holes are formed in the mold sidewalls 382, 383, and a coupling bolt 387 is inserted therein and coupled to a buried but 388 buried in the concrete member 440. The buried nut 388 is configured as explained above, and it is buried in advance at a position corresponding to the coupling hole of the sidewall when the concrete member 440 is formed.

At this time, for more film and stable coupling, auxiliary plates 389, 390 may be additionally provided.

The mold-concrete composite crossbeam of this embodiment is constructed as explained above, so it is not described in detail again.

A mold-concrete composite crossbeam according to another embodiment of the present invention is shown in FIGS. 49 and 50.

Referring to FIGS. 49 and 50, in the composite crossbeam of this embodiment, the mold is separately configured with a fixed mold part 510 and a detachable mold part 520. The fixed mold part 510 is connected to a column at both ends of the mold-concrete composite crossbeam and used as a permanent structure buried or fixed in the placed concrete, while the detachable mold part 520 is dismantled after the concrete is cured, and then utilized again.

The fixed mold part 510 and the detachable mold part 520 are interconnected using a plurality of connectors 530, 540, 550. That is to say, bottoms of the mold parts 510, 520 are interconnected using the connector 530, and sidewalls of the mold parts 510, 520 are interconnected using the connectors 540, 550. At this time, connection bolts 511, 512, 521, 522, 531, 532 pass through the through holes formed in the connectors 530, 540, 550 and the coupling holes formed in the fixed and detachable mold parts 510, 520 and respectively coupled to buried nuts 513, 514, 523, 524, 533, 534.

The mold-concrete composite crossbeam of this embodiment is constructed in the same way as explained above. In addition, in order to separate the detachable mold part 520 after concrete is cured, the connection bolts 511, 512, 521, 522, 531, 532 are released to remove the connectors 530, 540, 550, and then the detachable mold part 520 is detached. At this time, the fixed mold part 510 remains as a permanent structure together with concrete, and the buried nuts 513, 514, 523, 524, 533, 534 also remain buried in the concrete.

The fixed mold part and the detachable mold part may be connected with ach other in various ways, as shown in FIGS. 51 and 52 as an example. Components other than the mold parts are not illustrated in FIGS. 51 and 52 for simplification.

Referring to FIGS. 51 and 52, the fixed mold part 510 and the detachable mold part 520 are interconnected using connectors 610 and 620, 630 and 640, 650 and 660 having a L-shaped section. One pair of connectors 610, 620 include coupling units 610*a*, 620*a* coupled to the bottoms of the mold parts 510, 520, and extensions 610*b*, 620*b* extended in a perpendicular direction from the coupling units 610*a*, 620*a* and coupled with each other in contact.

In addition, one pair of connectors 630, 640 include coupling units 630*a*, 640*a* coupled to one sidewalls of the mold parts 510, 520 respectively, and extensions 630*b*, 640*b* extended in a perpendicular direction from the coupling units 630*a*, 640*a* and coupled with each other in contact.

In addition, one pair of connectors 650, 660 include coupling units 650*a*, 660*a* coupled to the other sidewalls of the mold parts 510, 520, and extensions 650*b*, 660*b* extended in a perpendicular direction from the coupling units 650*a*, 660*a* and coupled with each other in contact.

The coupling units 610*a*, 620*a*, 630*a*, 640*a*, 650*a*, 660*a* are respectively fixed using connection bolts 621, 622, 641, 642, 661, 662 and buried nuts 623, 624, 643, 644, 663, 664, and the extensions 610*b*, 620*b*, 630*b*, 640*b*, 650*b*, 660*b* are coupled with each other using coupling bolts 611, 631, 651 and coupling nuts 612, 632, 652.

The composite mold of this embodiment is constructed in the same way as explained above. Also, in order to dismantle the mold after concrete is molded, the connection bolt and the coupling bolts are released to remove the connectors, and then the detachable mold part 520 may be separated.

INDUSTRIAL APPLICABILITY

As described above, the mold-concrete composite crossbeam according to the present invention gives the following effects.

First, the mold-concrete composite crossbeam of the present invention may effectively reduce the height of story without giving any influence on the safety of structure.

Second, the mold-concrete composite crossbeam of the present invention may allow effective resistance against the bending stress and compression stress applied to a structure.

Third, the mold-concrete composite crossbeam of the present invention does not need any separate fire-resistant coating on the H-steel.

Fourth, the mold-concrete composite crossbeam of the present invention has the exposed steel bar inclined relatively toward outside from its center so that the exposed steel bar passes aside a column during construction, so there is no need of cutting or finishing the exposed steel bar or welding the exposed steel bar to the column.

Fifth, the mold-concrete composite crossbeam of the present invention is already provide with a mold, so there is no need of additionally installing a mold. Thus, the present invention allows easier construction, and the mold may be easily separated and recycled after concrete is cured.

Sixth, the mold-concrete composite crossbeam of the present invention may adjust the length of the concrete member as required, and may also significantly reduce the entire weight of the concrete composite shape steel by forming a hollow in at least a part of the concrete member, so it may be easily carried and constructed.

Seventh, according to the present invention, it is not required to construct a stud that is installed for connection between existing frame beams and slabs.

Eighth, the mold-concrete composite crossbeam of the present invention may be very easily installed and constructed, and the composite crossbeam is constructed to be suspended, thereby ensuring a working space below it and also facilitating the following process.

Ninth, the construction method using the mold-concrete composite crossbeam according to the present invention allows a short term of works and reduced construction costs since underground stories are preliminarily constructed with placing only beams or a part of slab and beams without installing the entire slab, and then the main construction is progressed together with constructing stories over the ground.

The invention claimed is:

1. A mold-concrete composite crossbeam, comprising:

a H-steel composed of an upper flange, a lower flange, and a web connecting the upper and lower flanges to each other;

a concrete member formed in a length direction of the H-steel so that the upper flange of the H-steel is exposed out but the lower flange and the web are at least partially buried therein;

deck plate supports installed to both side edges of an upper surface of the concrete member so as to support a deck plate placed thereon;

a reinforcing steel bar installed around the H-steel;

a mold including a bottom detachably coupled to a lower end surface of the concrete member, and a pair of sidewalls formed in parallel to both sides of the bottom and detachably coupled to both end sides of the concrete member;

a lateral reinforcing member coupled across both sidewalls of the mold to support the sidewalls;

a side reinforcing member installed to an outer side of the sidewalls of the mold in a length direction thereof; and a plurality of bottom reinforcing members installed across a lower surface of the bottom of the mold to support the lower surface.

2. The mold-concrete composite crossbeam according to claim 1, wherein a plurality of buried nuts for preventing contact with concrete are provided to an end of the concrete member, and coupling bolts are inserted into a plurality of coupling holes formed in the mold and coupled to the buried nuts so as to fix the mold to the concrete member.

3. The mold-concrete composite crossbeam according to claim 1, wherein extension support units extended outward in both side directions are formed on upper edges of the sidewalls of the mold to support the deck plate.

4. The mold-concrete composite crossbeam according to claim 1, wherein the reinforcing steel bar includes:

a plurality of stirrup steel bars installed in a length direction of the H-steel at regular intervals to surround at least a part of the H-steel; and a plurality of tension/compression steel bars installed in parallel in a length direction of the H-steel.

5. A mold-concrete composite crossbeam, comprising:

a H-steel composed of an upper flange, a lower flange and a web connecting the upper flange and the lower flange;

a main concrete member formed in a length direction of the H-steel and having a thickness ($T_2$) that exposes the upper flange of the H-steel out buries the lower flange and at least a part of the web therein, and a sub concrete member continuously extended from an end of the main concrete member and having a thickness ($T_1$) relatively smaller than the main concrete member;

deck plate supports installed to both side edges of an upper surface of the concrete member so as to support a deck plate placed thereon;

a reinforcing steel bar installed around the H-steel;

a mold including a bottom detachably coupled to a lower end surface of the concrete member, and a pair of sidewalls formed in parallel to both sides of the bottom and detachably coupled to both end sides of the concrete member;

a mold including a pair of sidewalls detachably coupled to both end sides of the main concrete member and both sides of the sub concrete member;

a lateral reinforcing member coupled across both sidewalls of the mold to support the sidewalls; and a side reinforcing member installed to an outer side of the sidewalls of the mold in a length direction thereof.

6. The mold-concrete composite crossbeam according to claim 5, wherein a plurality of buried nuts are provided to both end sides of the main concrete member and both sides of the sub concrete members to prevent contact with concrete, and coupling bolts are inserted through a plurality of coupling holes formed in the sidewalls of the mold and coupled to the buried nuts so as to fix the mold to the concrete member.

7. The mold-concrete composite crossbeam according to claim 5, wherein extension support units extended outward in both side directions are formed on upper edges of the sidewalls of the mold so as to support the deck plate.

8. The mold-concrete composite crossbeam according to claim 5, wherein the reinforcing steel bar includes:

a plurality of stirrup steel bars installed in a length direction of the H-steel at regular intervals to surround at least a part of the H-steel; and a plurality of tension/compression steel bars installed in parallel in a length direction of the H-steel.

9. The mold-concrete composite crossbeam according to claim 8, wherein the stirrup steel bars include:

a lower steel bar unit extended across a lower portion of the lower flange of the H-steel;

an intermediate steel bar unit extended upward from both ends of the lower steel bar unit; and an extension steel bar unit extended in both side directions from a front end of the intermediate steel bar unit.

10. The mold-concrete composite crossbeam according to claim 9, wherein the extension steel bar unit is located at a position relatively higher or lower than the upper flange of the H-steel.

11. The mold-concrete composite crossbeam according to claim 8, wherein the stirrup steel bar has a closed shape so that both ends of the stirrup steel bar are contacted to both sides of the web with surrounding the lower flange of the H-steel bar, whereby an upper portion of the stirrup steel bar is not buried in the concrete member but exposed out.

12. The mold-concrete composite crossbeam according to claim 11, further comprising a plurality of extension members having a L-shaped section so that one ends of the extension members are fixed to both sides of the top of the stirrup steel bar and the other ends are extended outward in both side directions.

13. The mold-concrete composite crossbeam according to claim 12, wherein the extension member has a front end located at a position relatively higher or lower than the upper flange of the H-steel.

14. A method for constructing a building, comprising:

(a) installing a steel column at a position that will become a column of the building;

(b) connecting both ends of a mold-concrete composite crossbeam to the steel column, the mold-concrete composite crossbeam including: a H-steel composed of an upper flange, a lower flange, and a web connecting the upper and lower flanges to each other; a concrete member formed in a length direction of the H-steel having a thickness such that the upper flange of the H-steel is exposed out but the lower flange and the web are at least partially buried therein; deck plate supports installed to both side edges of an upper surface of the concrete member so as to support a deck plate placed thereon; a reinforcing steel bar installed around the H-steel; a mold including a bottom detachably coupled to a lower end surface of the concrete member, and a pair of sidewalls formed in parallel to both sides of the bottom and detachably coupled to both end sides of the concrete member; a lateral reinforcing member coupled across both sidewalls of the mold to support the sidewalls; a side reinforcing member installed to an outer side of the sidewalls of the mold in a length direction thereof; and a plurality of bottom reinforcing members installed across a lower surface of the bottom of the mold across the lower surface;

(c) placing a deck plate on the deck plate supports;

(d) installing a steel bar on the deck plate;

(e) putting concrete on the deck plate and the mold of the composite crossbeam to place and cure beam and slab; and (f) dismantling the mold of the composite crossbeam.

15. The method for constructing a building according to claim 14, wherein extension support units extended outward in both side directions are formed on upper edges of the sidewalls of the mold so as to support the deck plate, and wherein the step (c) includes the step of inserting coupling bolts through coupling holes formed in the extension support units and through holes formed in the deck plate and then coupling the coupling bolts to buried nuts.

16. The method for constructing a building according to claim 14, further comprising:

installing a prefabricated column mold composed of a plurality of sub mold bodies to surround the steel column; and coupling the mold to an opening of the sub mold body.

* * * * *